US007954931B2

(12) United States Patent
Shimizu et al.

(10) Patent No.: US 7,954,931 B2
(45) Date of Patent: Jun. 7, 2011

(54) CONTAINER HOLDER, LIQUID CONSUMING APPARATUS, AND LIQUID CONTAINER

(75) Inventors: Kazutoshi Shimizu, Nagano-ken (JP); Izumi Nozawa, Nagano-ken (JP); Hitotoshi Kimura, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 539 days.

(21) Appl. No.: 11/935,987

(22) Filed: Nov. 6, 2007

(65) Prior Publication Data

US 2008/0106575 A1 May 8, 2008

(30) Foreign Application Priority Data

Nov. 6, 2006 (JP) ..... 2006-300935
Sep. 14, 2007 (JP) ..... 2007-240195

(51) Int. Cl.
*B41J 2/175* (2006.01)

(52) U.S. Cl. ..... 347/85; 347/49; 347/86

(58) Field of Classification Search ..... 347/86, 347/20, 108, 49
See application file for complete search history.

(56) References Cited

U.S. PATENT DOCUMENTS 4,277,791 A 7/1981 Rosenstock et al.
4,367,383 A 1/1983 Sommansson
4,467,159 A 8/1984 Ota et al.
4,661,667 A 4/1987 Sorimachi et al.
5,211,431 A 5/1993 Koizumi et al.
5,291,224 A 3/1994 Asano et al.
5,500,664 A 3/1996 Suzuki et al.
5,642,143 A 6/1997 Rhoads
5,699,091 A 12/1997 Bullock et al.
5,745,139 A 4/1998 Sasaki
5,798,775 A 8/1998 Takahashi et al.
5,805,187 A 9/1998 Sasaki
5,841,453 A 11/1998 Sasaki
5,949,459 A 9/1999 Gasvoda et al.
6,070,975 A 6/2000 Uchikata et al.
6,130,695 A 10/2000 Childers et al.
6,158,837 A * 12/2000 Hilton et al. ..... 347/19
6,250,750 B1 6/2001 Miyazawa et al.
6,264,314 B1 7/2001 Mochizuki et al.
6,276,789 B1 8/2001 Miyazaki et al.
6,281,912 B1 8/2001 Silverbrook
6,286,949 B1 9/2001 Lewis et al.
6,290,332 B1 9/2001 Crystal et al.
6,302,535 B1 10/2001 Sturgeon et al.
6,312,084 B1 11/2001 Ujita et al.
6,402,298 B1 6/2002 Nanjo et al.
6,431,681 B2 8/2002 Hatasa et al.

(Continued)

FOREIGN PATENT DOCUMENTS

CN 1 349 894 5/2002

(Continued)

OTHER PUBLICATIONS

European Patent Office, European Search Report, Nov. 6, 2009.

(Continued)

*Primary Examiner* — Ellen Kim
(74) *Attorney, Agent, or Firm* — Stroock & Stroock & Lavan LLP

(57) ABSTRACT

A container holder can accommodate liquid containers with high density without deteriorating electrical connection between an apparatus terminal and a circuit board.

11 Claims, 14 Drawing Sheets

U.S. PATENT DOCUMENTS

| | | | | |
|---|---|---|---|---|
| 6,431,697 | B1 | 8/2002 | King et al. | |
| 6,454,381 | B1 | 9/2002 | Olsen et al. | |
| 6,460,982 | B1 | 10/2002 | Ito et al. | |
| 6,467,869 | B1 | 10/2002 | Merz et al. | |
| 6,471,333 | B1 | 10/2002 | Powell et al. | |
| 6,502,917 | B1 | 1/2003 | Shinada et al. | |
| 6,536,888 | B2 | 3/2003 | Trafton et al. | |
| 6,554,402 | B2 | 4/2003 | Trafton et al. | |
| 6,582,068 | B2 | 6/2003 | Ishizawa et al. | |
| 6,679,584 | B2 | 1/2004 | Silverbrook | |
| 6,722,762 | B2 | 4/2004 | Miyazawa et al. | |
| 6,742,872 | B2 | 6/2004 | Fukazawa et al. | |
| 6,749,292 | B2 | 6/2004 | Sturgeon et al. | |
| 6,755,514 | B2 | 6/2004 | Koga et al. | |
| 6,755,516 | B2 | 6/2004 | Hanson et al. | |
| 6,758,556 | B2 | 7/2004 | Ishizawa et al. | |
| 6,773,100 | B2 | 8/2004 | Kulpa et al. | |
| 6,817,699 | B2 | 11/2004 | Hirashima et al. | |
| 6,832,830 | B2 | 12/2004 | Seino et al. | |
| 6,834,945 | B2 | 12/2004 | Ishizawa et al. | |
| 6,843,558 | B2 | 1/2005 | Seino | |
| 6,886,928 | B2 | 5/2005 | Sasaki et al. | |
| 7,018,027 | B2 | 3/2006 | Harada et al. | |
| 7,448,734 | B2 | 11/2008 | Silverbrook | |
| 7,566,106 | B2 | 7/2009 | Silverbrook | |
| 7,717,541 | B2 * | 5/2010 | Shimizu et al. | 347/49 |
| 2002/0071011 | A1 | 6/2002 | Hayashi et al. | |
| 2002/0085075 | A1 | 7/2002 | Shinada et al. | |
| 2002/0109761 | A1 | 8/2002 | Shimizu et al. | |
| 2002/0196312 | A1 | 12/2002 | Ishizawa et al. | |
| 2004/0021737 | A1 | 2/2004 | Harada et al. | |
| 2004/0021738 | A1 | 2/2004 | Suganuma | |
| 2004/0210424 | A1 * | 10/2004 | Seino et al. | 702/189 |
| 2004/0212661 | A1 | 10/2004 | Tsuruma | |
| 2005/0036015 | A1 | 2/2005 | Seino et al. | |
| 2005/0068382 | A1 | 3/2005 | Kimura et al. | |
| 2005/0116998 | A1 | 6/2005 | Harada et al. | |
| 2005/0248637 | A1 | 11/2005 | Seino et al. | |
| 2006/0152564 | A1 * | 7/2006 | Hashii et al. | 347/86 |
| 2007/0222833 | A1 * | 9/2007 | Ishizawa et al. | 347/85 |
| 2009/0262154 | A1 | 10/2009 | Silverbrook et al. | |

FOREIGN PATENT DOCUMENTS

| | | | |
|---|---|---|---|
| DE | 28 12 562 | A1 | 9/1979 |
| DE | 35 45 621 | A1 | 6/1986 |
| DE | 90 18 060.7 | | 8/1990 |
| DE | 103 27 251 | A1 | 2/2004 |
| DE | 299 24 675 | | 9/2004 |
| EP | 0 412 459 | | 2/1991 |
| EP | 0 496 642 | A2 | 7/1992 |
| EP | 0 829 363 | A2 | 3/1998 |
| EP | 0 997 297 | A1 | 5/2000 |
| EP | 1 000 749 | A2 | 5/2000 |
| EP | 1 122 076 | A1 | 8/2001 |
| EP | 1 177 904 | A1 | 2/2002 |
| EP | 1 199 179 | A1 | 4/2002 |
| EP | 1 213 148 | A1 | 6/2002 |
| EP | 1 247 651 | | 10/2002 |
| EP | 1 323 533 | A2 | 7/2003 |
| EP | 1 354 709 | | 10/2003 |
| EP | 1 375 159 | A1 | 1/2004 |
| EP | 1375159 | | 1/2004 |
| EP | 1 457 341 | A2 | 9/2004 |
| EP | 1504907 | A2 | 2/2005 |
| EP | 1 623 834 | A1 | 2/2006 |
| FR | 2 837 422 | | 9/2003 |
| GB | 1164260 | | 9/1969 |
| GB | 2 241 201 | A | 8/1991 |
| GB | 2 315 045 | A | 1/1998 |
| GB | 2 321 623 | A | 8/1998 |
| GB | 2 343 145 | A | 5/2000 |
| GB | 2 387 567 | A | 10/2003 |
| GB | 2 391 200 | A | 4/2004 |
| JP | 60-133071 | U | 9/1985 |
| JP | 61-059054 | U | 4/1986 |
| JP | 63-271676 | A | 11/1988 |
| JP | 1-141750 | A | 6/1989 |
| JP | 02-88248 | A | 3/1990 |
| JP | 3-13628 | | 2/1991 |
| JP | 3-108557 | | 5/1991 |
| JP | 3-108557 | A | 5/1991 |
| JP | 03-193480 | | 8/1991 |
| JP | 03-197782 | A | 8/1991 |
| JP | 03-246039 | A | 11/1991 |
| JP | 4-247955 | A | 9/1992 |
| JP | 04-268686 | A | 9/1992 |
| JP | 04-119078 | U | 10/1992 |
| JP | 06-023757 | U | 3/1994 |
| JP | 06-064185 | A | 3/1994 |
| JP | 2504650 | | 4/1996 |
| JP | 08-169121 | A | 7/1996 |
| JP | 09-011500 | | 1/1997 |
| JP | 09-123479 | | 5/1997 |
| JP | 09-167033 | A | 6/1997 |
| JP | 09-309213 | | 12/1997 |
| JP | 10-006611 | A | 1/1998 |
| JP | 10-109427 | | 4/1998 |
| JP | 10-235888 | | 9/1998 |
| JP | 2000-309107 | | 11/2000 |
| JP | 2001-58417 | A | 6/2001 |
| JP | 2001-150691 | | 6/2001 |
| JP | 2001-260373 | | 9/2001 |
| JP | 2001-267013 | | 9/2001 |
| JP | 2001-277541 | | 10/2001 |
| JP | 2001-341323 | | 11/2001 |
| JP | 2002-019135 | | 1/2002 |
| JP | 2002-019227 | A | 1/2002 |
| JP | 2002-31108 | | 1/2002 |
| JP | 2002-044828 | A | 2/2002 |
| JP | 2002-127546 | A | 5/2002 |
| JP | 2002-240260 | A | 8/2002 |
| JP | 2002-254673 | | 9/2002 |
| JP | 2002-273889 | A | 9/2002 |
| JP | 2003-341100 | A | 12/2002 |
| JP | 2003-19817 | | 1/2003 |
| JP | 2003-175589 | | 6/2003 |
| JP | 2003-200590 | | 7/2003 |
| JP | 2004-66490 | A | 3/2004 |
| JP | 2004-74773 | A | 3/2004 |
| JP | 2004-167685 | | 6/2004 |
| JP | 2005-088575 | A | 4/2005 |
| JP | 2005-96446 | | 4/2005 |
| WO | 98/55318 | | 12/1998 |
| WO | 98/55324 | | 12/1998 |
| WO | 99/59823 | | 11/1999 |
| WO | 01/49499 | A1 | 7/2001 |
| WO | 2002-513340 | T | 5/2002 |
| WO | 2002-513341 | T | 5/2002 |
| WO | 2004/098895 | A1 | 11/2004 |

OTHER PUBLICATIONS

Australian Patent Office—First Report on Patent Application No. 2004203638—Oct. 12, 2009.

European Patent Office—Office Action Pursuant to Article 96(2) EPC—Sep. 13, 2006.

Office Action, dated Nov. 18, 2009, for German Application No. 10 2004 038 382.0-26.

Office Action, dated Feb. 17, 2010 for Japanese Appln. No. 2004-194203 with partial translation.

Office Action, dated Feb. 17, 2010 for Japanese Appln. No. 2004-194236 with partial translation.

Office Action for Japanese Patent Appln. No. 2003-168570, dated Jun. 9, 2009, and partial English translation thereof.

English language version of Office Action for Chinese Appln. 2007 10107316.0, Mar. 13, 2009.

U.S. Appl. No. 11/866,131.

Office Action, dated Aug. 25, 2009, for Japanese Application No. 2003-290713.

Office Action issued by the Mexican Patent Office (Instituto Mexicano de la Propiedad Industrial) on Mar. 26, 2010. A partial English translation is included in the attached letter from Mexican Patent Counsel.

Partial translation of an Office Action issued by the Japanese Patent Office on Apr. 6, 2010.

Office Action dated Mar. 29, 2010, in the related U.S. Appl. No. 11/866,131.
Office Action issued in U.S. Appl. No. 11/855,263, on Jun. 4, 2010.
International Search Report, IPRP and Written Opinion in PCT/JP2007/067982.
Vietnamese Office Action dated Dec. 1, 2010 of VN 1-2009-00728 patent application.
Office Action issued on Dec. 15, 2010 for New Zealand Patent Appln. No. 576676.

* cited by examiner

CONTAINER HOLDER, LIQUID CONSUMING APPARATUS, AND LIQUID CONTAINER

BACKGROUND

1. Technical Field

The present invention relates to a container holder of a liquid consuming apparatus detachably mounted with a liquid container having a pressurizing chamber into which a pressurization fluid are introduced and a liquid containing chamber in which liquids are contained.

2. Related Art

Exemplary liquid consuming apparatuses capable of ejecting liquid droplets from a liquid ejecting head include an ink jet printing apparatus mounted with an ink jet printing head for an image printing, a device mounted with a color material ejecting head used to manufacture a color filter such as liquid crystal display, a device mounted with an electrode material (conductive paste) ejecting head used to form an electrode such as an organic EL display or a field emission display (FED), a device mounted with a living-body organic matter ejecting head used to manufacture a bio chip, a device mounted with a sample ejecting head which is a precise pipette, and the like.

In particular, since the ink jet printing apparatus causes relatively small noise and can also form small dots with a high density in a printing, the ink jet printing apparatus has been recently used for the many printings including a color printing. As a type of supplying a liquid to the ink jet printing apparatus, there is a so-called cartridge type in which the liquid is supplied from a liquid container storing the liquid to the liquid consuming apparatus. The cartridge type is configured so that the liquid container is simply attached to or detached from the liquid consuming apparatus in order for a user to exchange the liquid container when the liquid contained in the liquid container are completely consumed.

In this type of liquid container, a circuit board mounted with a memory element (IC) for storing information on a ink type, a amount of residual liquid or the like may be disposed on an outer surface thereof. In this case, an apparatus terminal of the liquid consuming apparatus connected to a contact point of the circuit board is disposed in a container holder of the liquid consuming apparatus mounted with the liquid container. When the liquid container including such a circuit board is mounted in the container holder, it is necessary to reliably connect the contact point of the circuit board to the apparatus terminal of the liquid consuming apparatus. That is, it is necessary to connect the apparatus terminal to the contact point of the circuit board so as to be conductive.

Some liquid containers and container holders include, for example, a container fixation structure for releasably regulating a movement of the liquid container in a pulling direction of the liquid container in cooperation with an apparatus fixation structure formed in the container holder as a mechanism for firmly fixing the liquid container on a predetermined position of the container holder.

The container fixation structure includes a guide groove for releasably regulating the movement of the liquid container in a position opposite a insertion direction of the liquid container in cooperation with a locking pin of the apparatus fixation structure disposed in the container mounting portion when the liquid container is mounted in the container mounting portion against an urging force in the direction opposite the insertion direction.

When the liquid container is fixed on the container holder, the liquid container is inserted into the container mounting portion, further pushed against the urging force in the direction opposite the insertion direction by a slider member and a pressing force is released, the locking pin of the apparatus fixation structure is moved to a lock position of the guide groove and the liquid container is fixed.

In addition, when the liquid container is detached from the container holder, the container is pushed into the container mounting portion so that the locking pin is moved to a non-lock position of the guide groove. Accordingly, when the pressing force is released, the container is urged so as to be taken out in the direction opposite the insertion direction by the slider member.

Patent Document 1: JP-A-2005-88575

The known liquid container disclosed in Patent Document 1 realizes a reliable connection between the contact point of the circuit board and the contact point of the liquid consuming apparatus by disposing the circuit board in the vicinity of the apparatus fixation structure. Specifically, when substantially flat rectangular parallelepiped liquid containers are arranged in a direction in which a pair of flat largest surfaces are perpendicular to a vertical surface and arranged so that the largest surfaces are not overlapped vertically (hereinafter, referred to as "a vertically positioned"), the circuit board is disposed on a side surface and the apparatus fixation structure is disposed on a lower surface close to the side surface. That is, the circuit board and the container fixation structure are disposed on two surfaces which are near the outer surface of the container and are perpendicular to each other.

Recently, however, as the number of the liquid containers increases in order to improve printing quality, the liquid containers have been configured so as to be arranged lengthwise with high density.

However, the circuit board and the container fixation structure are disposed on the outer surfaces of the container that intersect each other. Accordingly, for example, when the known liquid containers are lengthwise arranged, for example, in this structure, gaps are normally interposed between the adjacent liquid containers in order to dispose the apparatus fixation structure. For this reason, the containers cannot be arranged with the high density.

Alternatively, when the apparatus fixation structure is separately positioned, positioning precision of the contact point of the circuit board is deteriorated. Accordingly, since the apparatus terminal and the contact point of the circuit board are easily detached, good electrical connection may not be obtained.

The liquid container disclosed in Patent Document 1 is an airtight type liquid container. The airtight type liquid container is formed in a flexible bag and the like having an airtight structure and designed to prevent a liquid from deteriorating due to air contact. In this way, since good quality of stored ink can be maintained for a long time, the airtight type liquid container is appropriate for a large-scale liquid container.

However, when the pressurization fluid are introduced into the pressurizing chamber from the outside in order to pressurize the flexible bag which is a liquid containing chamber, a pair of parallel largest surfaces of the liquid container are mainly expanded and deformed.

As described above, the circuit board is disposed in the side surface of the liquid container. Accordingly, when the liquid container is expanded and deformed, a position in which the apparatus terminal comes in contact with the contact point of the circuit board may be deviated, thereby resulting in contact failure. Moreover, the expansion and deformation of the liquid container may induce deviation of fixation location between the slots of the container holder and the liquid containers.

As a result, load may be applied to an engagement portion of the apparatus fixation structure and the container fixation structure, a partition wall of each slot, and the like. Consequently, since the locking pin, the guide groove, and the partition wall of each slot may be deformed, a more robust fixation mechanism is necessary, and thus manufacture cost may increase.

SUMMARY

An advantage of some aspects of the invention is to provide a container holder capable of liquid containers with high density without deteriorating electrical connection between the contact points of the apparatus terminal and the circuit board, a liquid consuming apparatus, and the liquid container. The advantage can be attained by at least one of the following aspects:

A first aspect of the invention provides a container holder of a liquid consuming apparatus to which substantially rectangular parallelepiped liquid containers can be detachably mounted, the liquid containers each having a front end surface with a substantially rectangular shape, a first side surface intersecting a first short side of the substantially rectangular shape, a second side surface intersecting a second short side of the substantially rectangular shape, a third side surface intersecting a first long side of the substantially rectangular shape, a fourth side surface intersecting a second long side of the substantially rectangular shape, a rear end surface opposed to the front end surface, a liquid containing chamber for containing a liquid, a pressurizing chamber for pressurizing the liquid containing chamber by introducing a pressurization fluid, and a liquid supply port for supplying the liquid to a liquid ejecting head, and each configured such that the third side surface and the fourth side surface are largest surfaces, the container holder comprising: a plurality of container mounting portions which can be mounted with a plurality of the liquid containers in parallel so as to oppose the largest surfaces to each other; a plurality of apparatus terminals, each terminal adapted to come in contact with an electrode of a circuit board disposed on the first side surface of each liquid container; a plurality of apparatus fixation structures, each apparatus fixation structure adapted to releasably regulate a movement of the liquid container in a direction opposite to an insertion direction thereof in cooperation with a container fixation structure disposed on the second side surface of each liquid container; a plurality of guide protrusions, each guide protrusion disposed along the insertion direction of the liquid container and having a shape corresponding to a shape of a notch formed along the insertion direction in a corner portion corresponding to a side in which at least two of the first to fourth side surfaces of each liquid container intersect each other; and a pair of support sidewalls opposed to largest surfaces each of which is not opposed to the largest surface of another liquid container, at both ends of the plurality of liquid containers mounted on the container mounting portions.

According to the container holder with the above-described configuration, when the liquid containers are mounted in the container mounting portions, a space formed by the notch is formed at least in one of an upper portion and a lower portion of the adjacent liquid containers. In addition, the guide protrusion is disposed in the space.

Each liquid container is guided in the insertion direction by the guide protrusion and positioned in the corresponding container mounting portion. That is, there is no partition wall for partitioning the container mounting portions between the adjacent liquid containers. Accordingly, it is not necessary for the plurality of the liquid containers to be spaced by the partition walls or the guide protrusions.

That is, the plurality of liquid containers can be accommodated more closely (with high density). As a result, it is possible to form the container holder with a small width size in a thickness direction of the liquid container and realize a compact size thereof.

In the container holder with the above-described configuration, when the pressurization fluid is introduced into the pressuring chamber of each liquid container, the pair of largest surfaces parallel with each other of the liquid containers are expanded and deformed. In addition, in the container holder with no partition wall, at least some largest surfaces of the adjacent liquid containers come in pressing contact with each other. Of the largest surfaces of the liquid containers in both ends, at least some largest surfaces which are not opposed to the largest surfaces of the other liquid containers come in contact with the support sidewalls of the container holder.

That is, when the pressurizing fluid is introduced into the liquid containers mounted in the container holder, the liquid containers become a locked state between the pair of support sidewalls by an expansion force of the liquid containers. The plurality of liquid containers of which the expansion deformation is regulated are fixed on the container mounting portions firmly and integrally.

Alternatively, when the pressurization in the pressurizing chamber is released and the expanded liquid containers return an original shape, the adjacent liquid containers do not come in pressing contact with each other any longer or the liquid containers do not come in pressing contact with the support sidewalls any longer. Accordingly, the liquid containers can be smoothly attached or detached.

In this way, according to the container holder with the above-described configuration, since the expansion and deformation of the liquid containers can be regulated at the time the liquid containers are pressurized. Accordingly, it is possible to prevent contact failure between the apparatus terminal and the contact point of the circuit board and also to prevent electrical connection thereof from deteriorating. Moreover, it is possible to reduce load applied to an engagement portion of the apparatus fixation structure and the container fixation structure. Moreover, since the plurality of liquid containers are fixed on the container mounting portions firmly and integrally by the expansion force of the liquid containers, it is not necessary to provide a partition wall for partitioning the container mounting portions in the container holder. As a result, it is possible to simplify the container holder and to reduce a size of the container holder.

The contact point of the electrode of the circuit board and the container fixation structure are disposed on the first side surface and the second side surface, respectively. Accordingly, it is not necessary to dispose the apparatus terminal and the apparatus fixation structure between the largest surfaces (the third or fourth side surface) of the adjacent liquid containers. As a result, it is possible to accommodate the plurality of liquid containers with high density.

That is, according to the container holder with the above-described configuration, it is possible to obtain the simplified and miniaturized container holder capable of receiving the plurality of liquid containers with the high density without deteriorating the electrical connection of the contact point between the apparatus terminal and the circuit board.

In the container holder with the above-described configuration, the guide protrusion may be disposed on a support board on which a plurality of the liquid containers can be arranged in parallel in a state where the largest surfaces of the liquid containers are directed in a direction parallel to a vertical surface.

According to the container holder with such a configuration, when the liquid containers are mounted in the container mounting portions, the guide protrusions are disposed in the lower portions between the adjacent liquid containers.

That is, when the liquid containers are attached to or detached from the container mounting portions, the lower portions of the liquid containers are guided. Accordingly, it is easy to attach or detach the liquid containers. Moreover, the liquid containers are more reliably positioned in the container mounting portions.

In the container holder with such a configuration, a second guide protrusion disposed opposite the guide protrusion disposed on the support board may protrude at least in the vicinity of an opening for attachment and detachment of each container mounting portion.

According to the container holder with such a configuration, when each liquid container is attached to or detached form the corresponding container mounting portion, the upper portion of each liquid container is guided by the second guide protrusion. As a result, it is further easy to attach or detach the liquid containers.

A second aspect of the invention provides a liquid consuming apparatus comprising: a liquid ejecting head for ejecting a liquid; a plurality of substantially rectangular parallelepiped liquid containers each liquid container having a front end surface with a substantially rectangular shape, a first side surface intersecting a first short side of the substantially rectangular shape, a second side surface intersecting a second short side of the substantially rectangular shape, a third side surface intersecting a first long side of the substantially rectangular shape, a fourth side surface intersecting a second long side of the substantially rectangular shape, a rear end surface opposed to the front end surface, a liquid containing chamber for containing the liquid, a pressurizing chamber for pressurizing the liquid containing chamber by introducing a pressurization fluid, and a liquid supply port for supplying the liquid to the liquid ejecting head, and each configured such that the third side surface and the fourth side surface are the largest surfaces; a pressurization fluid supply mechanism for introducing the pressurization fluid into the liquid containers; a liquid supply mechanism for supplying the liquid from the liquid containers to the liquid ejecting head; the container holder according to any one of claims 1 to 3 to which the liquid containers are detachably mounted, wherein the plurality of liquid containers each has: a circuit board with at least one electrode on the first side surface, a contact point of the electrode being electrically connected to an apparatus terminal; a container fixation structure releasably regulating a movement of the liquid container in a direction opposite to insertion direction in cooperation with an apparatus fixation structure on the second side surface; and a notch disposed along the insertion direction in a corner portion corresponding to a side in which at least two of the first to fourth side surfaces of each liquid container intersect each other.

According to the liquid consuming apparatus with the above-described configuration, the liquid consuming apparatus can be configured to be compact since using the simplified and miniaturized container holder capable of receiving the plurality of liquid containers with the high density without deteriorating the electrical connection of the contact point between the apparatus terminal and the circuit board A third aspect of the invention is to provide a liquid container comprising: a front end surface with a substantially rectangular shape; a first side surface intersecting a first short side of the substantially rectangular shape; a second side surface intersecting a second short side of the substantially rectangular shape; a third side surface intersecting a first long side of the substantially rectangular shape; a fourth side surface intersecting a second long side of the substantially rectangular shape, the third side surface and the fourth side surface being largest surfaces; a rear end surface opposed to the front end surface, a liquid containing chamber for containing a liquid; a pressurizing chamber for pressurizing the liquid containing chamber by introducing a pressurization fluid; a liquid supply port for supplying the liquid to a liquid ejecting head; a circuit board with at least one electrode on the first side surface, a contact point of the electrode being electrically connected to a terminal of a liquid consuming apparatus; a container fixation structure for releasably regulating a movement of the liquid container in a direction opposite to an insertion direction in cooperation with an apparatus fixation structure of the liquid consuming apparatus on the second side surface; and a notch disposed along the insertion direction in a corner portion corresponding to a side in which at least two of the first to fourth side surfaces of the liquid container intersect each other.

According to the liquid container with the above-described configuration, it is possible to obtain the simplified and miniaturized container holder capable of accommodating the plurality of liquid containers with the high density without deteriorating the electrical connection of the contact point between the apparatus terminal and the circuit board. Moreover, the liquid consuming apparatus using the container holder having the above-described configuration can become compact.

In the liquid container with the above-described configuration, the pressurizing chamber of the liquid container may be partitioned by a bag receiving portion with one open surface and a sheet film sealing the open surface of the bag receiving portion, and the liquid containing chamber may be formed by a flexible bag having a liquid lead-out portion for leading out the stored liquid to the outside.

According to the liquid container with such a configuration, it is easy to configure an airtight structure of the pressurizing chamber and the liquid containing chamber. As a result, it is possible to reduce manufacturing cost.

In the liquid container with the above-described configuration, a pair of positioning holes may be formed in the front end surface, and a movement in a direction along the front end surface may be regulated by fitting the pair of positioning holes to a pair of positioning pins disposed in the liquid consuming apparatus.

According to each liquid container with such a configuration, when each liquid container is mounted in the corresponding container mounting portion, the pair of positioning pins are inserted into the pair of positioning holes disposed on the front end surface in the insertion direction of the liquid container. Afterward, as each liquid container is further inserted, each liquid container is moved on the basis of the positioning pins. When each liquid container is completely mounted, the positioning holes are fitted to the positioning pins, and thus a direction along the front end surface of the liquid container is determined. Accordingly, the movement of each liquid container in the direction along the front end surface in the insertion direction is regulated. That is, since each liquid container can be mounted in the container mounting portion with an exact inclination, it is easy to mount the liquid container. Moreover, even when each liquid container is mounted with an erroneous inclination, it is possible to prevent the apparatus terminal, the container fixation structure, or the apparatus fixation structure from being broken.

Moreover, when each liquid container is mounted in the container mounting portion, it is possible to maintain good electrical connection between the circuit board and the apparatus terminal or good fixation state between the container fixation structure and the apparatus fixation structure.

In the liquid container with the above-described configuration, the pair of positioning holes, the circuit board, and the container fixation structure may be disposed substantially on the same vertical section.

According to each liquid container with such a configuration, when each liquid container is mounted in the container mounting portion and the one pair of positioning pins disposed on the container mounting portion are fitted to the one pair of positioning holes disposed on the front end surface of the liquid container, each liquid container is positioned in the direction (that is, which is parallel to the vertical section) along the front end surface of each liquid container. Accordingly, the contact point of the circuit board and apparatus terminal positioned on one side of the vertical section and the fixation structures positioned on the other side of the vertical section are positioned with the high density in an approach direction or a departing direction.

BRIEF DESCRIPTION OF THE DRAWINGS

The invention will be described with reference to the accompanying drawings, wherein like numbers reference like elements.

FIG. 6(*b*) is a perspective view illustrating the apparatus fixation structure 50 shown from a side opposite the ink cartridges 100. FIG. 6(*c*) is a sectional view illustrating the vicinity of the apparatus fixation structure 50.

FIG. 15(*b*) is a diagram illustrating the front end surface 11 when viewed from an arrow D.

DESCRIPTION OF EXEMPLARY EMBODIMENTS

Hereinafter, an exemplary embodiment of a liquid container, a container holder, and a liquid consuming apparatus will be described in detail with reference to the accompanying drawings.

Figure 1:
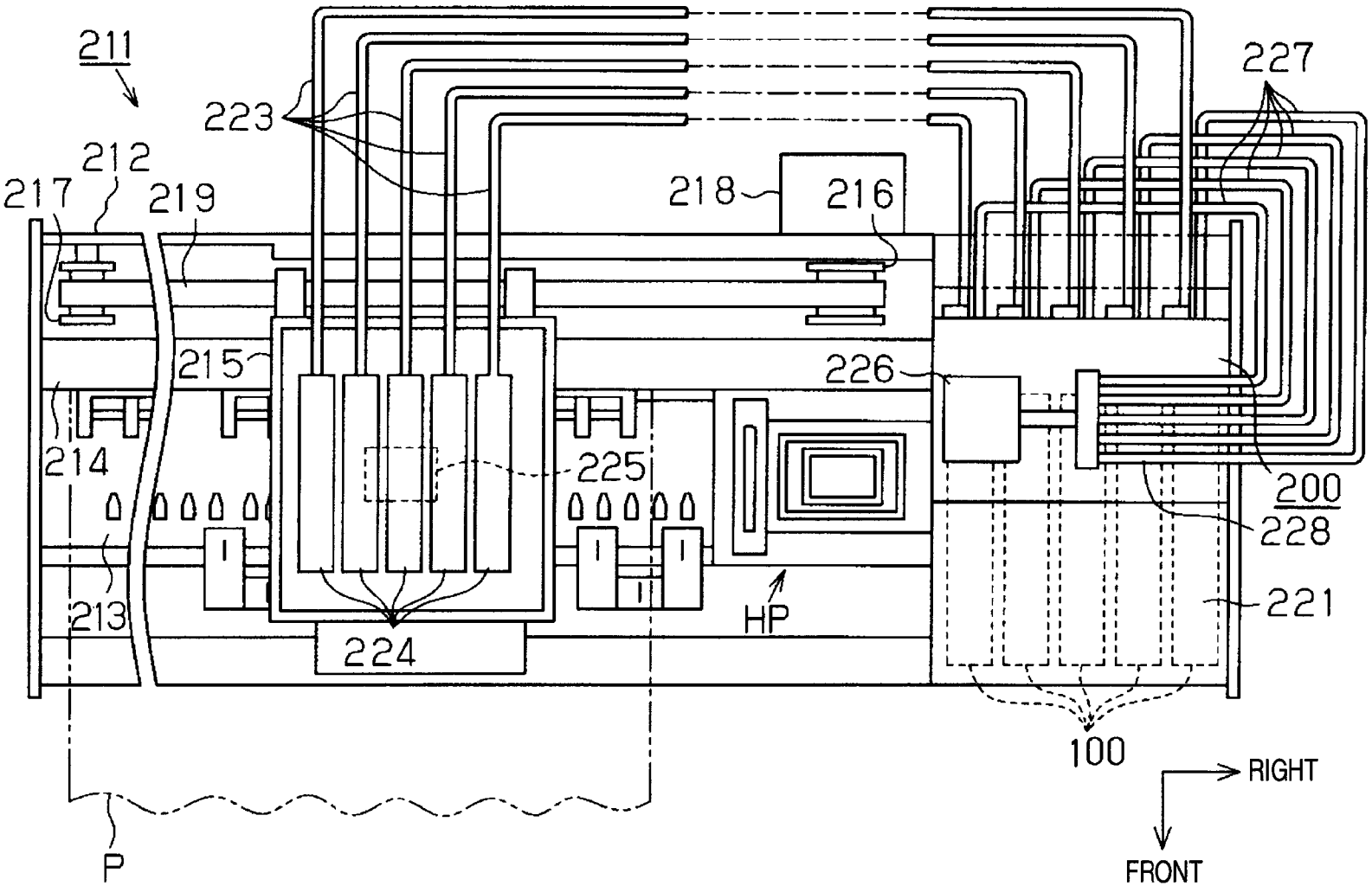
FIG. 1 is a diagram illustrating an overall configuration of a liquid consuming apparatus according to an embodiment of the invention.

FIG. 1 is a diagram illustrating an overall configuration of the liquid consuming apparatus according to this embodiment of the invention. As shown in FIG. 1, an ink jet printing apparatus 211, which is a liquid consuming apparatus according to this embodiment, includes a main body case 212 with a substantial rectangular box-like shape. In a front lower portion of the inside of the main body case 212, a platen 213 is disposed in a length direction (right and left directions in FIG. 1) of the main body case 212, which is a primary scanning direction. The platen 213 is a support board for supporting a print sheet P which is a target. On the platen 213, the print sheet P is configured to be transported along a secondary scanning direction perpendicular to the primary scanning direction by a paper-feeding mechanism (not shown).

In a rear upper portion of the platen 213 in the main body case 212, a guide shaft 214 with a bar shape is disposed along the primary scanning direction. A carriage 215 is movably supported in the guide shaft 214 along the guide shaft 214.

In a rear side surface of the inside of the main body case 212, a driving pulley 216 and a driven pulley 217 are rotatably supported in positions corresponding to both end portions of the guide shaft 214. A carriage motor 218 is connected to the driving pulley 216 and an endless timing belt 219 for supporting the carriage 215 is suspended between the pair of driving pulley 216 and the driven pulley 217. Accordingly, the carriage 215 is configured to reciprocate along the guide shaft 214 in the primary scanning direction by drive of the carriage motor 218.

A cartridge holder 200, which is a container holder with a box-like shape, is disposed in one end (right end in FIG. 1) of the inside of the main body case 212. The cartridge holder 200 is configured as a cover portion 221 which can open or close portions corresponding to front portions of a front wall and an upper wall. A user can exchange an ink cartridge 100, which is a liquid container, by opening the cover portion 221. That is, in a state where the cover portion 221 is opened, a plurality of the ink cartridges 100 (5 cartridges according to this embodiment) prepared for colors of ink, which are liquids, are configured to be attached to or detached from the cartridge holder 200 when inserted or removed in front and rear directions.

Each ink cartridge 100 is configured to be connected to an upstream end of corresponding ink supply passages 223 when mounted in the cartridge holder 200. In addition, a downstream end of each ink supply passage 223 is connected to the upstream end of a corresponding valve unit 224 mounted in the carriage 215. Downstream sides of the valve units 224 are configured to be connected to a print head 225, which is a liquid ejecting head, disposed in the lower surface of the carriage 215. The ink supply passages 223 and the valve units 224 are a liquid supply mechanism for supplying liquids supplied from the ink cartridge 100 to the print head 225.

A home position HP which is an evacuation position of the print head 225 is disposed between the cartridge holder 200 and the platen 213. In addition, before a print start and the like, the print head 225 is in the home position HP and various maintenance operations such as a cleaning of the print head 225 are performed.

In the inside of the main body case 212, a pressurizing pump 226 is disposed in an upper side of the cartridge holder 200. The pressurizing pump 226, which is a supply source of pressurizing air (a pressurization fluid), is connected to the upstream end of pressurization air supply passages 227. The number of the pressurization air supply passages 227 divided from distributors 228 disposed on the downstream side of the pressurizing pump 226 is the same as that of the ink cartridge 100. The downstream end of each divided pressurization air supply passage 227 is connected to the corresponding ink cartridge 100. In addition, the pressurizing pump 226, the pressurization air supply passage 227, and the distributors 228 constitute the pressurization fluid supply mechanism for supplying the pressurization fluid to the ink cartridges 100. In this embodiment, as the pressurization fluid, air is used, but another gas different from air, liquids, or the like may be used.

Figure 2:
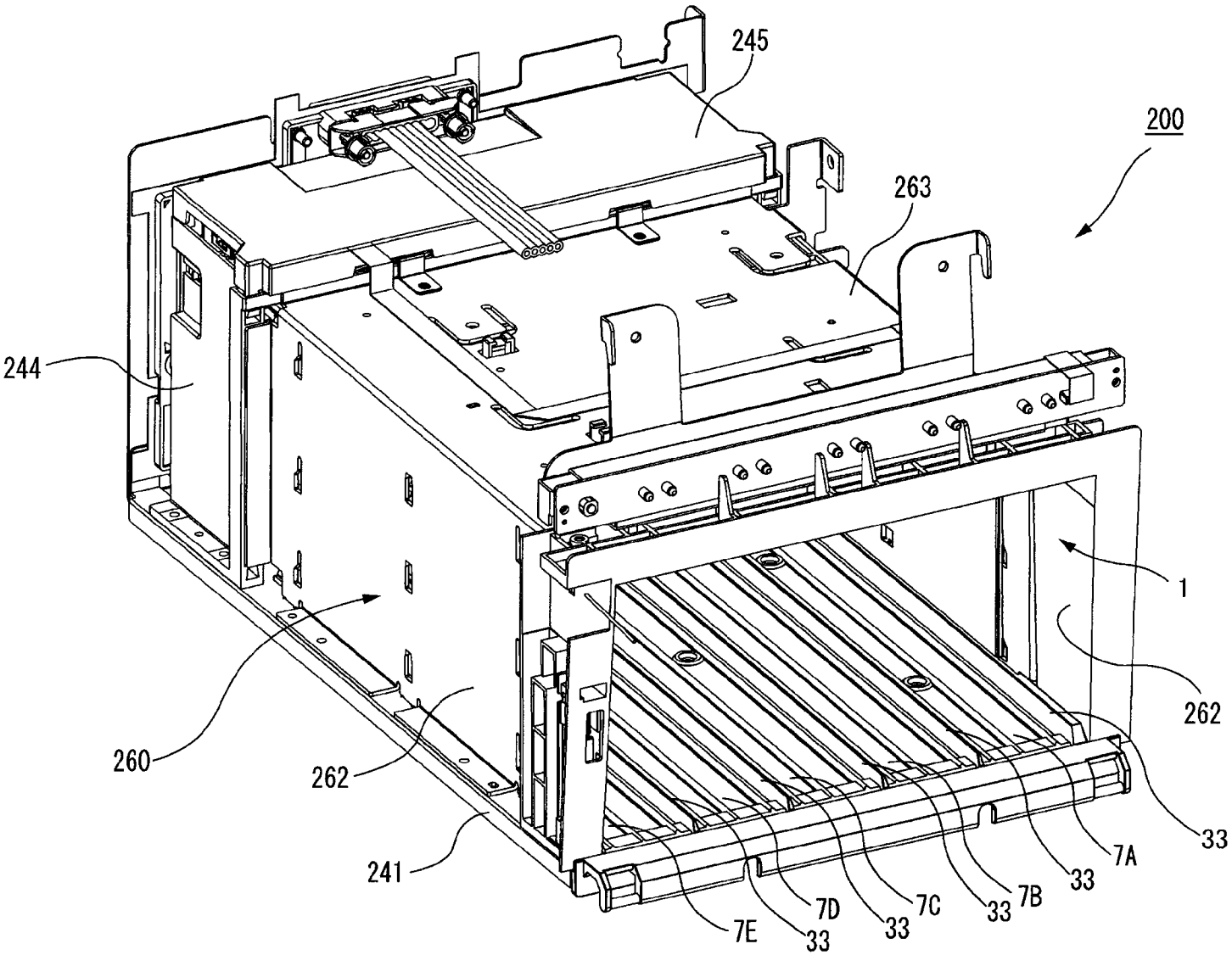
FIG. 2 is a perspective view illustrating a container holder mounted with liquid containers when obliquely viewed from the upside.
Figure 3:
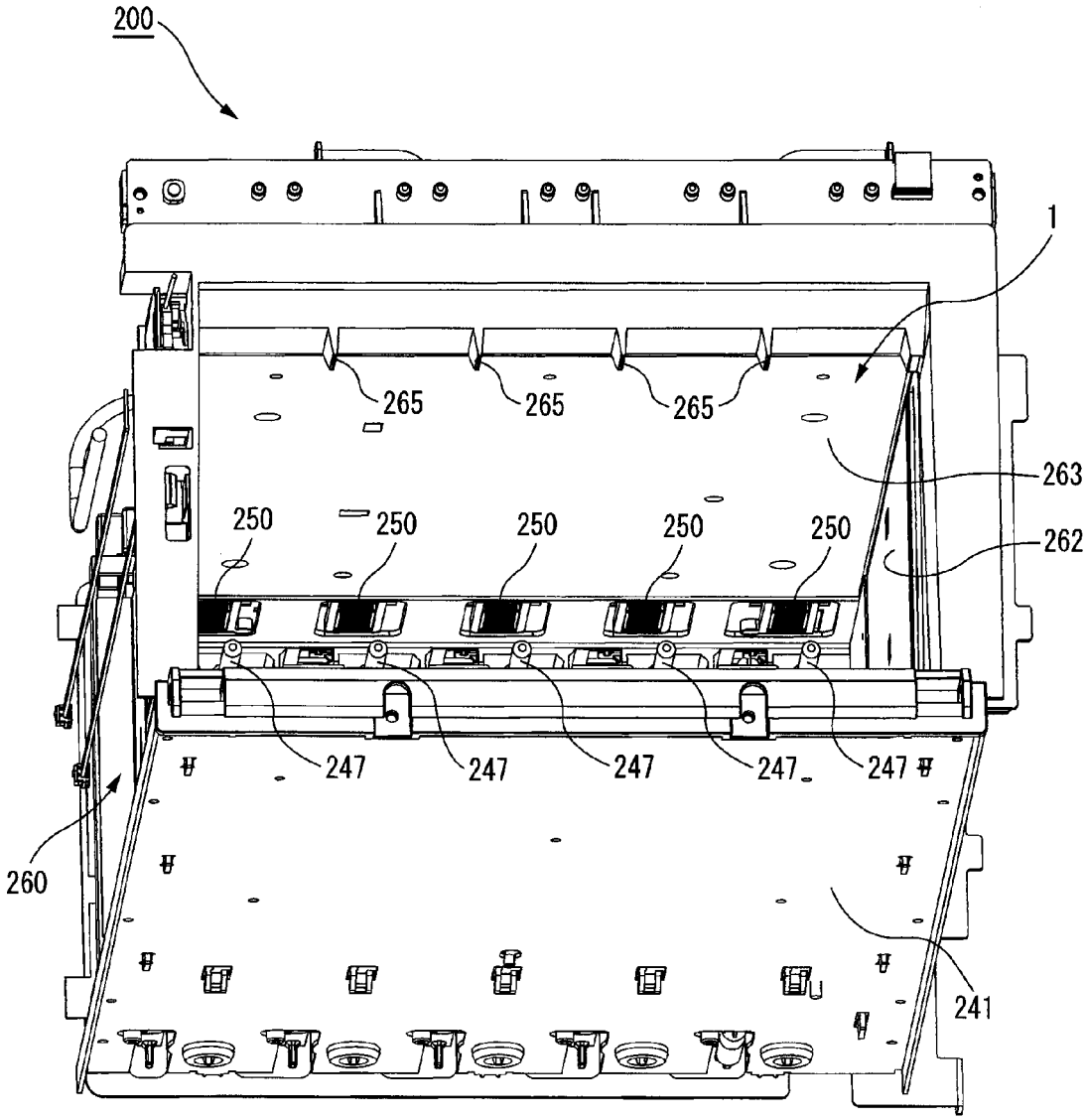
FIG. 3 is a perspective view illustrating the container holder shown in FIG. 2 when obliquely viewed from the downside.
Figure 4:
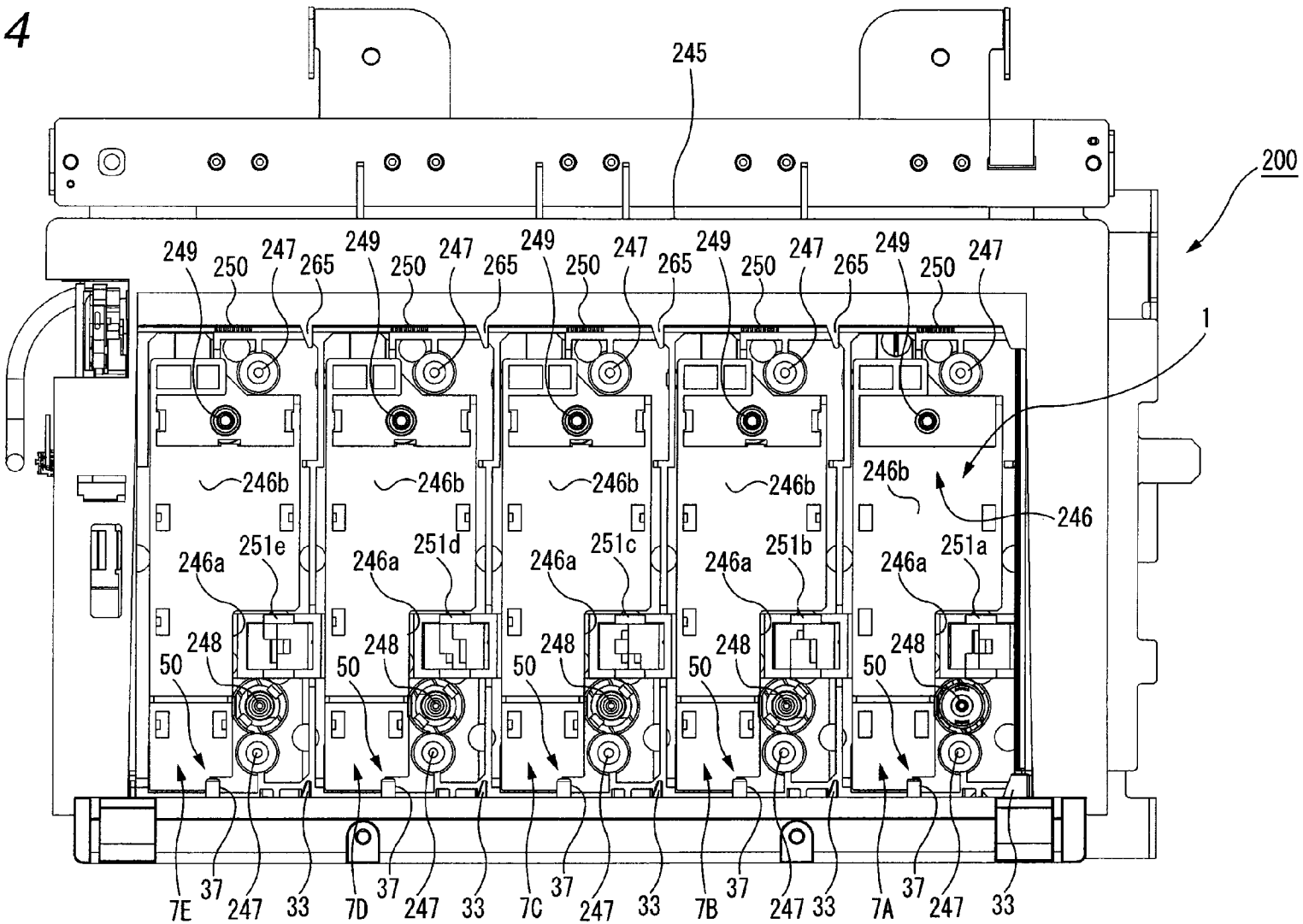
FIG. 4 is a front view illustrating the container holder shown in FIG. 2.
Figure 5:
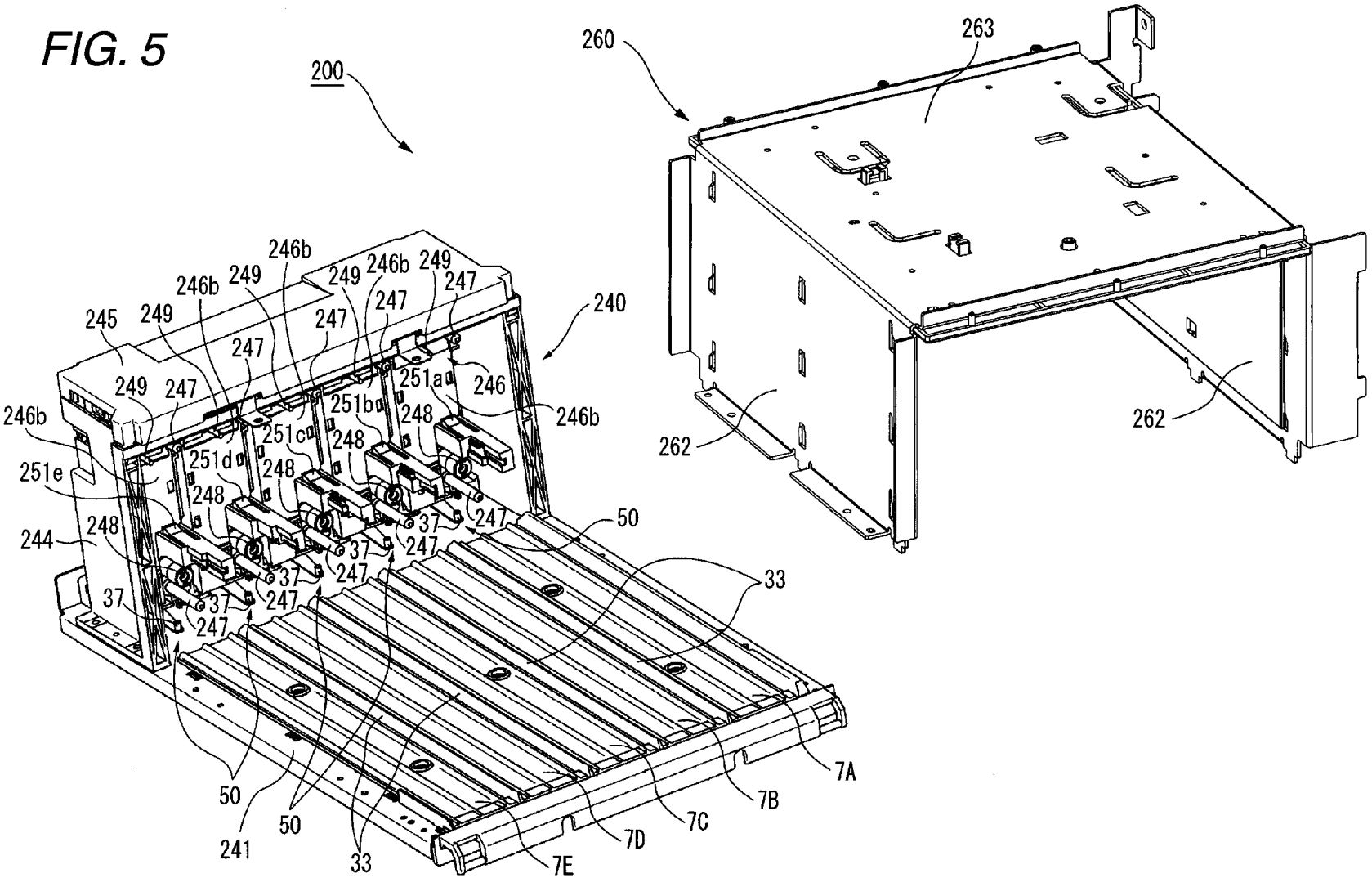
FIG. 5 is an exploded perspective view illustrating the container holder shown in FIG. 2.

FIG. 2 is a perspective view illustrating the container holder mounted with the liquid containers when obliquely viewed from the upside. FIG. 3 is a perspective view illustrating the container holder shown in FIG. 2 when obliquely viewed from the downside. FIG. 4 is a front view illustrating the container holder shown in FIG. 2. FIG. 5 is an exploded perspective view illustrating the container holder shown in FIG. 2.

As shown in FIGS. 2 to 5, the cartridge holder 200 includes a holder main body 240 with a substantial L shape in a side view and a frame body 260 with a D shaped sectional surface.

Figure 7:
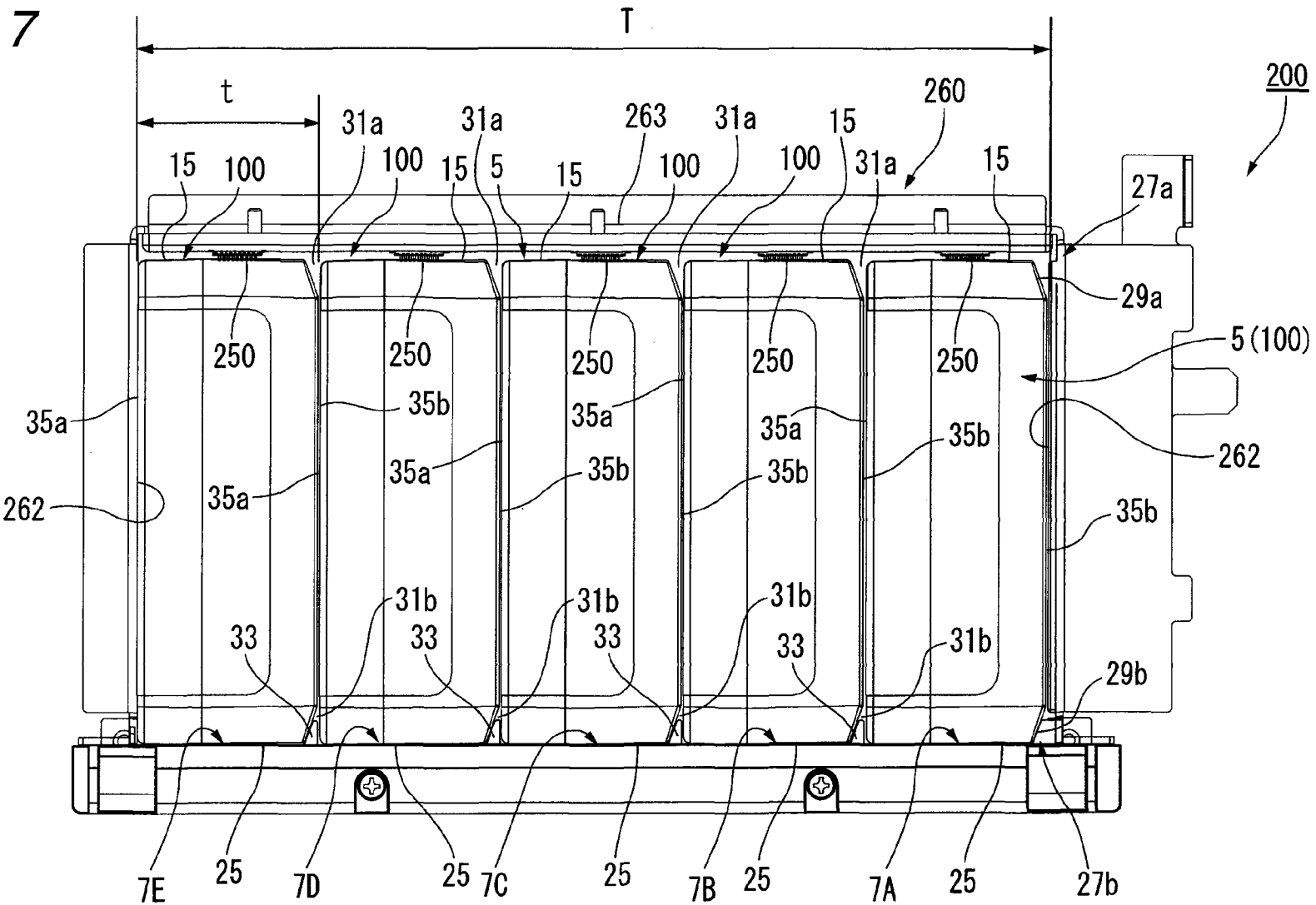
FIG. 7 is a front view illustrating the container holder mounted with the liquid container.

As shown in FIGS. 5 and 7, the frame body 260 includes a pair of side walls 262 and a top wall 263 connecting the upper ends of the side walls 262. The frame body 260 is integrally formed of a metal plate by a press forming.

As shown in FIG. 5, a holder main body 240 includes a board 241, which is made of a resin material or a metal material and has a substantially rectangular shape in a top view, and a wall body 244 mounted on the rear upper surface of the board 241.

The board 241 is a support board for placing the ink cartridges 100 in parallel when the ink cartridges 100 are mounted in the cartridge holder 200. On the board 241, a plurality of guide rails 33, which are first guide protrusions, are disposed so as to be extended in line along front and rear directions. The guide rails 33 are disposed to guide the ink cartridges 100 when the ink cartridges 100 are attached to or detached from the holder 200. In the inside of the cartridge holder 200, the guide rails 33 partition five cartridge slots 7A to 7E. The cartridge slots 7A to 7E serve as a container mounting portion for separately receiving each ink cartridge 100 of each color.

The wall body 244 is a molded product with a ⊃ shape in a top view. The wall body 244 is mounted on the board 241 so as to be opened toward an opening frontward. A top plate 245 formed in a rectangular shape is mounted on the upper surface of the wall body 244.

The wall body 244 includes a rear surface (not shown). In addition, the wall body 244 includes a slider member 246 having surfaces 246*b* substantially parallel to the rear surface of the wall body 244. The slider member 246 is configured to be urged frontward, that is, in a direction opposite an insertion direction of the ink cartridges 100 by urging means (not shown). The surfaces 246*b* of the slider member 246 are formed of an inward end section of the cartridge slots 7A to 7E. When the ink cartridges 100 are not mounted into the cartridge slots 7A to 7E, the slider member 246 is positioned on a front side by a force of the urging means.

When the ink cartridges 100 are inserted into the cartridge slots 7*a* to 7E, the slider member 246 is pushed by the front end surfaces 11 (see FIGS. 9, 11, and 12) of the ink cartridges 100 and is moved rearward.

When the ink cartridges 100 are completely mounted into the cartridge slots 7A to 7E, the slider member 246 is stopped in a predetermined position. Even when the ink cartridges 100 are mounted into the cartridge slots 7A to 7E, the force of the urging means allows the slider member 246 to normally apply an urging force to the mounted ink cartridges 100 in the direction opposite the insertion direction. When the ink cartridges 100 are detached from the cartridge slots 7A to 7E, the ink cartridges 100 are applied by the urging force to be pushed frontward.

In the slider member 246, opening portions 246*a* for exposing each pair of positioning pins 247 disposed on the rear surface of the wall body 244, air communicating ports 248, ink supply pins 249, and identification members 251*a* to 251*e* frontward from the rear surface of the wall body 244 are provided.

On the rear surface of the wall body 244, that is, on an inward end surface of the respective cartridge slots 7A to 7E, the pairs of positioning pins 247, the air communicating ports 248, the ink supply pins 249, and the identification member 251*a* to 251*e* are disposed so as to be protrude frontward through the opening portions 246*a* of the slider member 246.

The pairs of positioning pins 247, the air communicating ports 248, the ink supply pins 249, the identification member 251*a* to 251*e* on the front surface of the slider member 246, which is the inward end surface of container mounting portions 1, function when the ink cartridges 100 are mounted in the cartridge slots 7A to 7E on the board 241.

One pair of positioning pins 247 are used to position each ink cartridge 100. The one pair of positioning pins 247 are disposed on the upper portion and the lower portion of the inward end surface of each of the cartridge slots 7A to 7E.

The air communicating ports 248, which is positioned between the one pair of positioning pins 247 vertically provided and inserted into the positioning holes 21 and 23 of each ink cartridge 100, is used to supply air to each ink cartridge 100. The air communicating port 248 is disposed on the lower portion of the inward end surface of each of the cartridge slots 7A to 7E. In addition, the air communicating port 248 is disposed substantially on an imaginary line connecting the one pair of positioning pins 247 to each other and on a position close to the positioning pin 247 in the lower portion.

The ink supply pin 249 is used to supply the ink from each ink cartridge 100 to the print head 225 (see FIG. 1) through the ink supply passages 223 (see FIG. 1). The ink supply pin 249 is disposed on the upper portion of the inward end surface of each of the cartridge slots 7A to 7E. In addition, the ink supply pin 249 is positioned between the one pair of positioning pins 247 vertically provided, and disposed in a position which is offset from the imaginary line connecting the one pair of the positioning pins 247 in a width direction and a position close to the positioning pin 247 in the upper portion.

The identification members 251*a* to 251*e* are used to prevent the ink cartridges 100 from being erroneously mounted. The identification members 251*a* to 251*e* are disposed on the lower portion of the inward end surface of the cartridge slots 7A to 7E, respectively. In addition, the identification members 251*a* to 251*e* are disposed in the position between the one pair of positioning pins 247 and a position right above the air communicating ports 248. That is, the identification members 251*a* to 251*e* are disposed in the position between the upper positioning pin 247 and the air communicating port 248 and a position close to the air communicating port 248.

From the position right above the air communicating ports 248, front end portions of the plurality of identification members 251*a* to 251*e* (which are 5 members in this embodiment) are configured to protrude frontward through notches 246*a* formed so as to be cut from the lower portions of the slider member 246.

The identification members 251*a* to 251*e* each have a hollow-hole cylindrical shape of which the rear end surface, which is a base end, are opened and which extend in front and rear directions. An uneven fitting portion is formed in the front end of each of the identification member 251*a* to 251*e*. In addition, an identification portion 22 (see FIG. 9) corresponding to the shape of the uneven fitting portion of each of the identification member 251*a* to 251*e* is formed on the front end surface in the insertion direction of each ink cartridge 100. The shape of the identification portion 22, as the detailed shape is omitted, is different depending on a type of the ink cartridge 100.

Each of the uneven fitting portions of the identification members 251*a* to 251*e* is configured to be fitted only to the identification portion 22 of one type of the ink cartridge 100, but not to be fitted to the identification portions 22 of the other types of the ink cartridges 100. In this way, the ink jet printing apparatus according to this embodiment is configured to prevent the ink cartridges 100 from being erroneously mounted by combination of the identification portions 22 of the ink cartridges 100 and the uneven fitting portions of the identification members 251*a* to 251*e*.

As shown in FIGS. 3 and 4, second guide protrusions 265 of which the sectional surfaces each have a triangle are disposed on a surface opposite the top plate 245 of the wall body 244, on the front side of the upper surface of the cartridge slots 7A to 7E. In addition, apparatus terminals 250 are disposed on the inward side.

The guide protrusions 265 are disposed opposite the guide rails 33. Like the guide rails 33, the second guide protrusions 265 are used to guide the ink cartridges 100 when the ink cartridges 100 are attached to or detached from the cartridge slots 7A to 7E of the container holder 200.

When the ink cartridges 100 are mounted in the cartridge slots 7A to 7E, the apparatus terminals 250 come in contact with contact points 17*a* (see FIG. 9) of the electrodes of circuit boards 17 (see FIG. 9) disposed in the ink cartridges 100 to be electrically connected to the electrodes.

Figure 6:
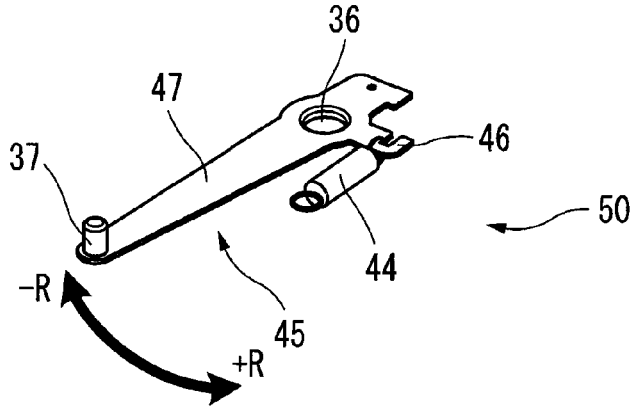
FIG. 6(*a*) is a perspective view illustrating a lever member 45 and a spring 44 shown from the side of the ink cartridges 100.
Figure 6:
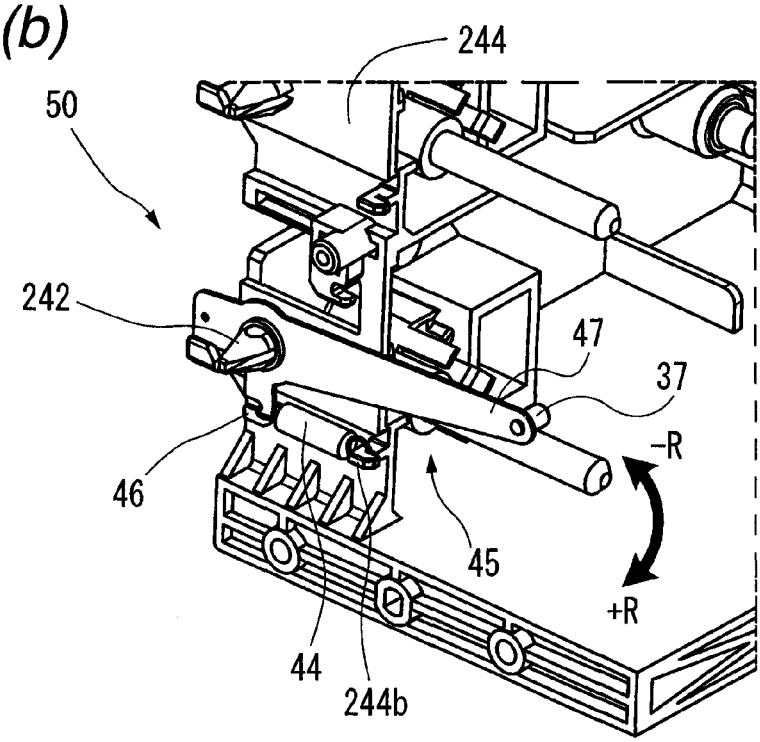
Figure 6:
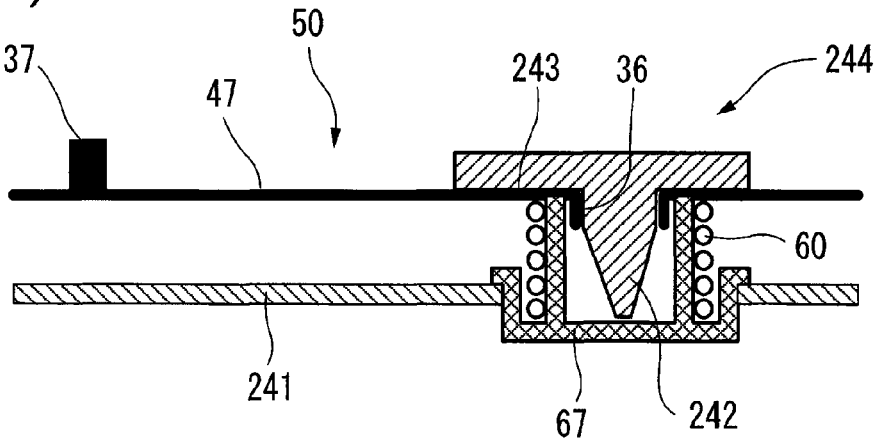

The apparatus fixation structure 50 is provided on the lower side and inward side (rear side) of the cartridge slots 7A to 7E. FIG. 6(*a*) is a perspective view illustrating a lever member 45 and a spring 44 constituting the apparatus fixation structure 50 shown from the side of the ink cartridges 100. FIG. 6(*b*) is a perspective view illustrating the apparatus fixation structure 50 shown from a side opposite the ink cartridges 100. FIG. 6(*c*) is a sectional view illustrating the vicinity of the apparatus fixation structure 50.

As shown in FIG. 6(C), the apparatus fixation structure 50 has the lever member 45 extending substantially in parallel to the board 241, that is, the lower portion of the cartridge slots 7A to 7E (see FIG. 3).

The lever member 45 has a slim long lever main body 47 with elasticity, a shaft hole 36 disposed in a base end portion, and a substantial cylindrical locking pin 37 protruding on the upper surface (which is a surface of the ink cartridge 100) of the front end portion of the lever main body 47. There is a gap between a bottom surface 243 and board 241 of the wall body 244 and the lever member 45 is arranged by using the gap.

A protruding portion 242 is provided on the bottom surface 243 of the wall body 244. The shaft hole 36 of the lever member 45 is inserted into the protruding portion 242. The lever member 45 is axially supported so as to be rotatable on the protruding portion 242. That is, the protruding portion 242 functions as a rotation shaft of the lever member 45. The circumference of the protruding portion 242 is supported by a cap 38 and coil springs 60 accommodated in the groove of the cap 38. The coil springs 60 have a function of rotatably supporting the lever member 45 on the board 241 and a function of stabilizing the movement of the lever member 45 by urging the lever member 45 upward.

As shown in FIGS. 6(*a*) and 6(*b*), the apparatus fixation structure 50 has the spring 44 for applying an urging force of a rotation direction (−R direction) to the lever member 47. One end of the spring 44 is locked in the locking portion 46 disposed in a position inclined in a direction different from a direction facing from the shaft hole 36 of the lever member 47 toward the locking portion 37. The other end of the spring 44 is locked in the locking portion 244*b* disposed on the lower surface of the wall body 244. When a force against the urging force of the spring 44 is applied to the lever member 45, the lever member 45 rotatably moves in an arrow +R direction shown in FIGS. 6(*a*) and 6(*b*).

Figure 8:
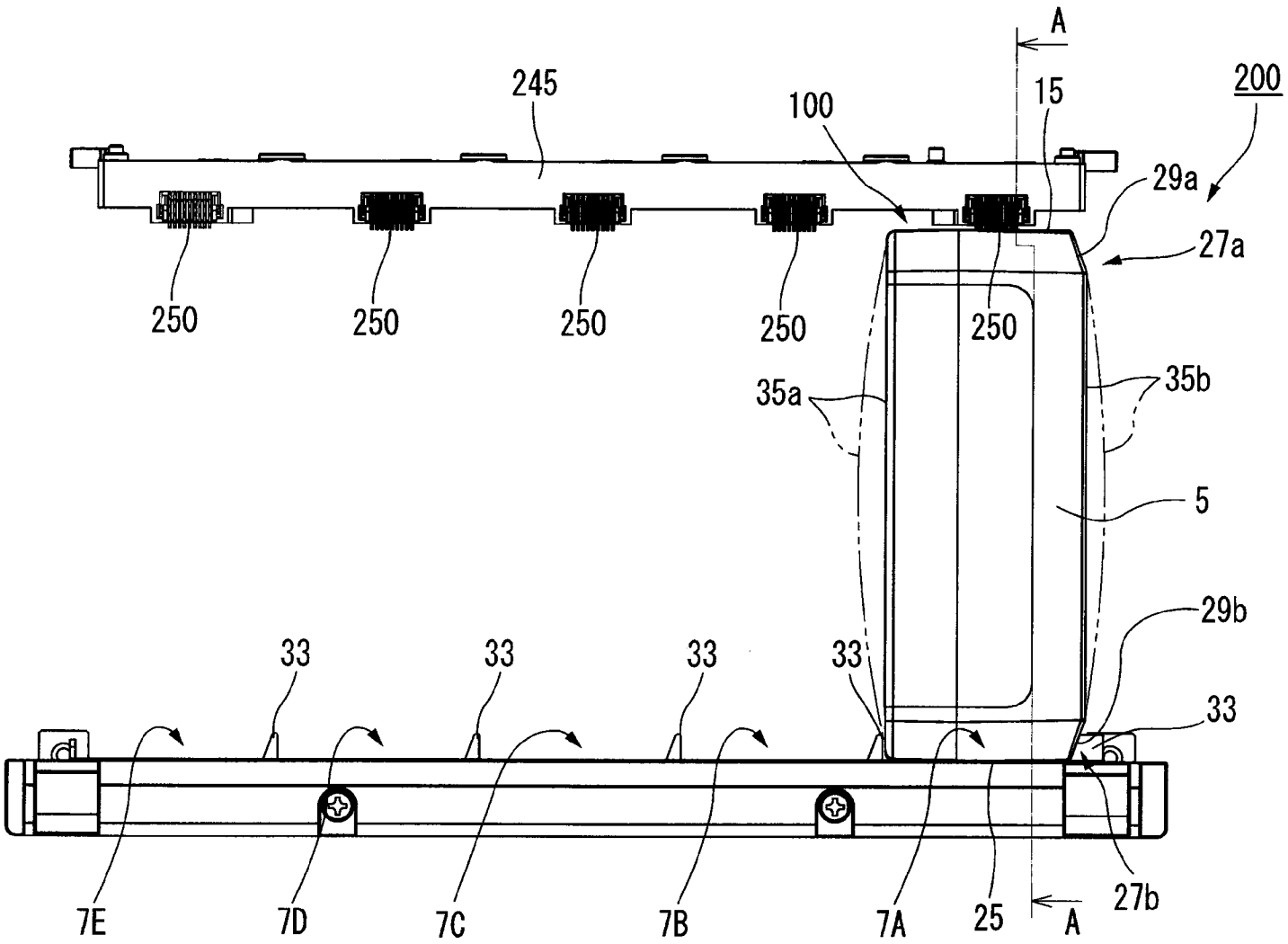
FIG. 8 is a front view illustrating the container holder mounted with some liquid containers.

FIG. 7 is a front view illustrating the container holder mounted with the liquid containers. FIG. 8 is a front view illustrating the container holder in which some liquid containers are detached. As shown in FIGS. 7 and 8, the ink cartridges 100 according to this embodiment are detachably mounted in the cartridge slots 7A to 7E of the cartridge holder 200 of the available ink jet printing apparatus 211 (see FIG. 1), which is the liquid consuming apparatus, to supply the ink to the print head 255 of the ink jet printing apparatus.

Figure 9:
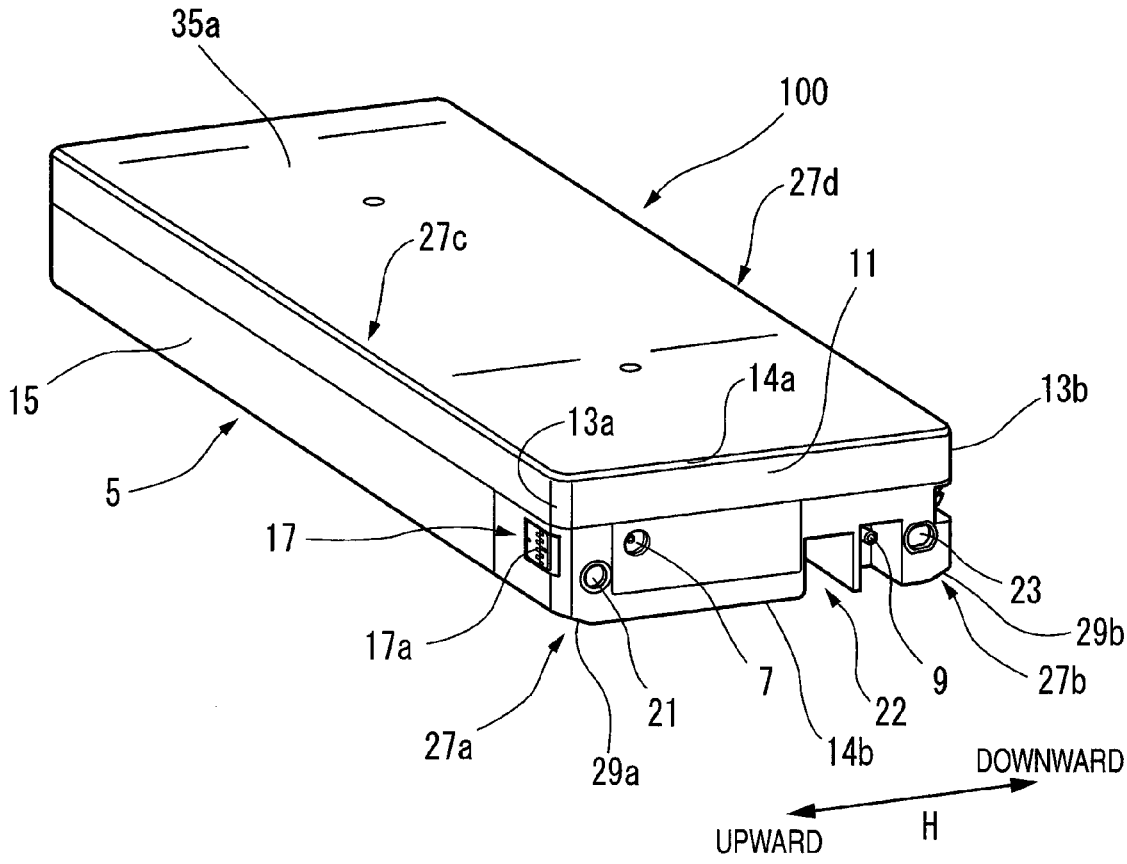
FIG. 9 is a perspective view illustrating the liquid container when viewed from one side surface.
Figure 10:
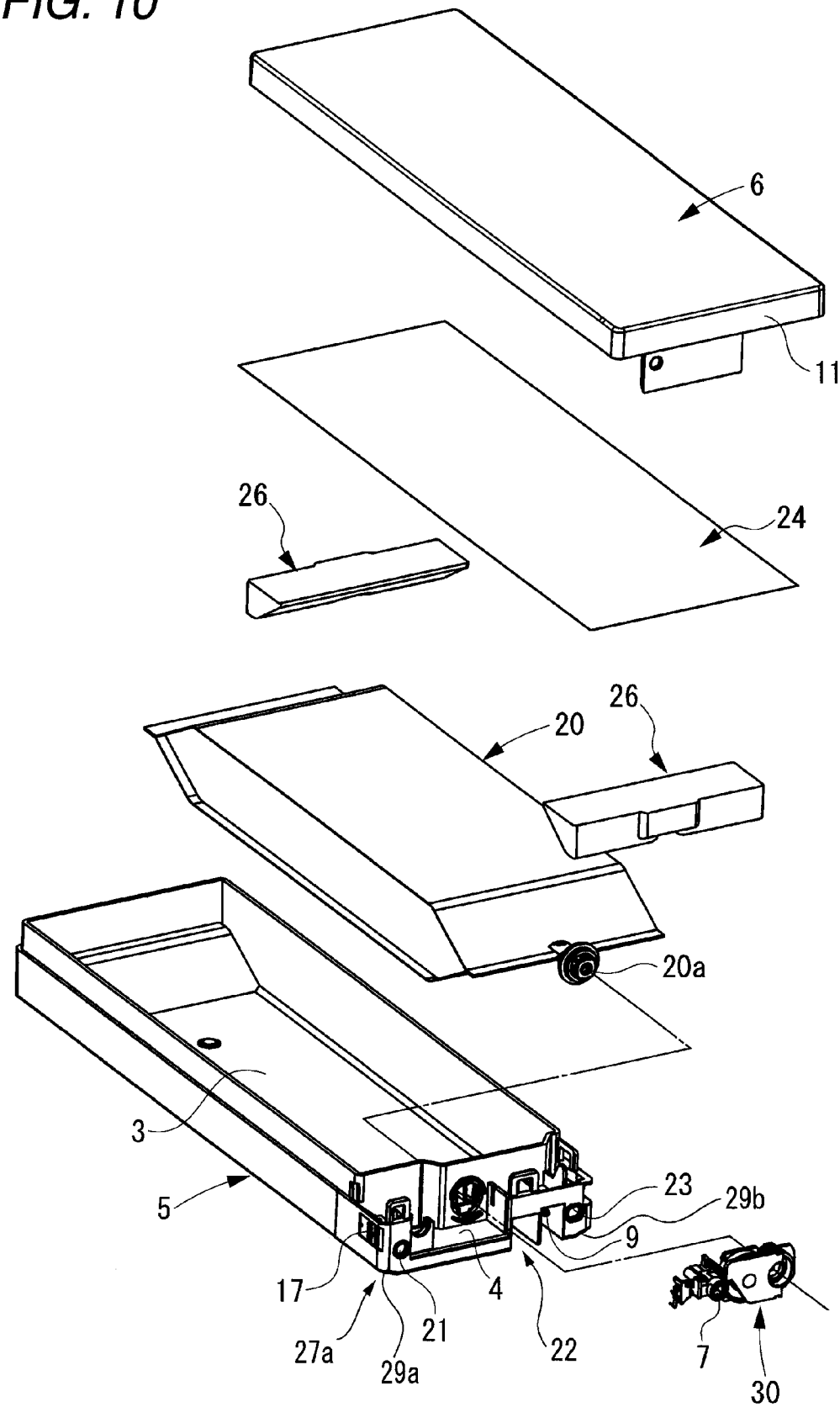
FIG. 10 is an exploded perspective view illustrating the liquid container shown in FIG. 9.
Figure 11:
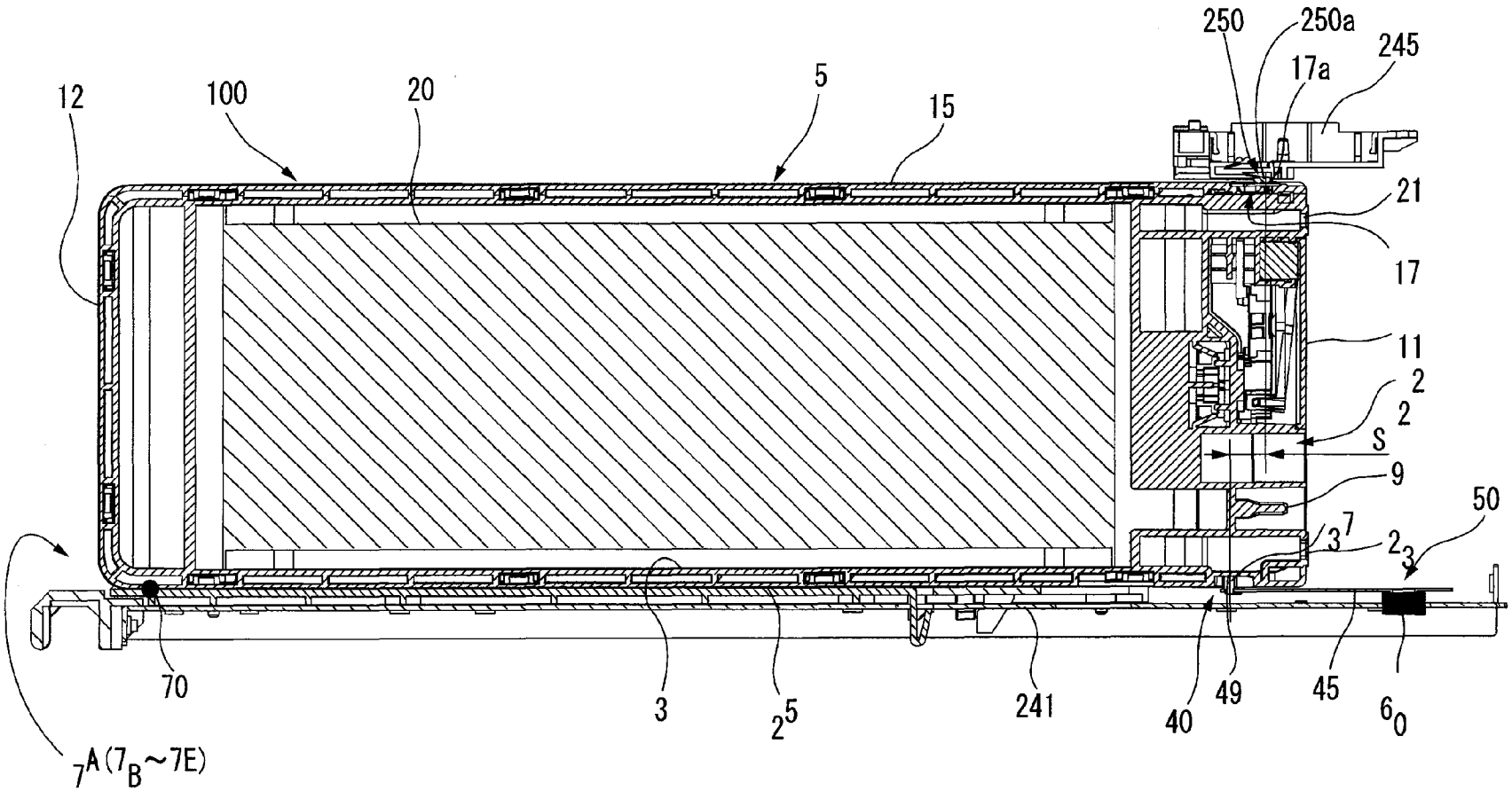
FIG. 11 is a diagram illustrating the container holder taken along the line A-A in FIG. 8.
Figure 12:
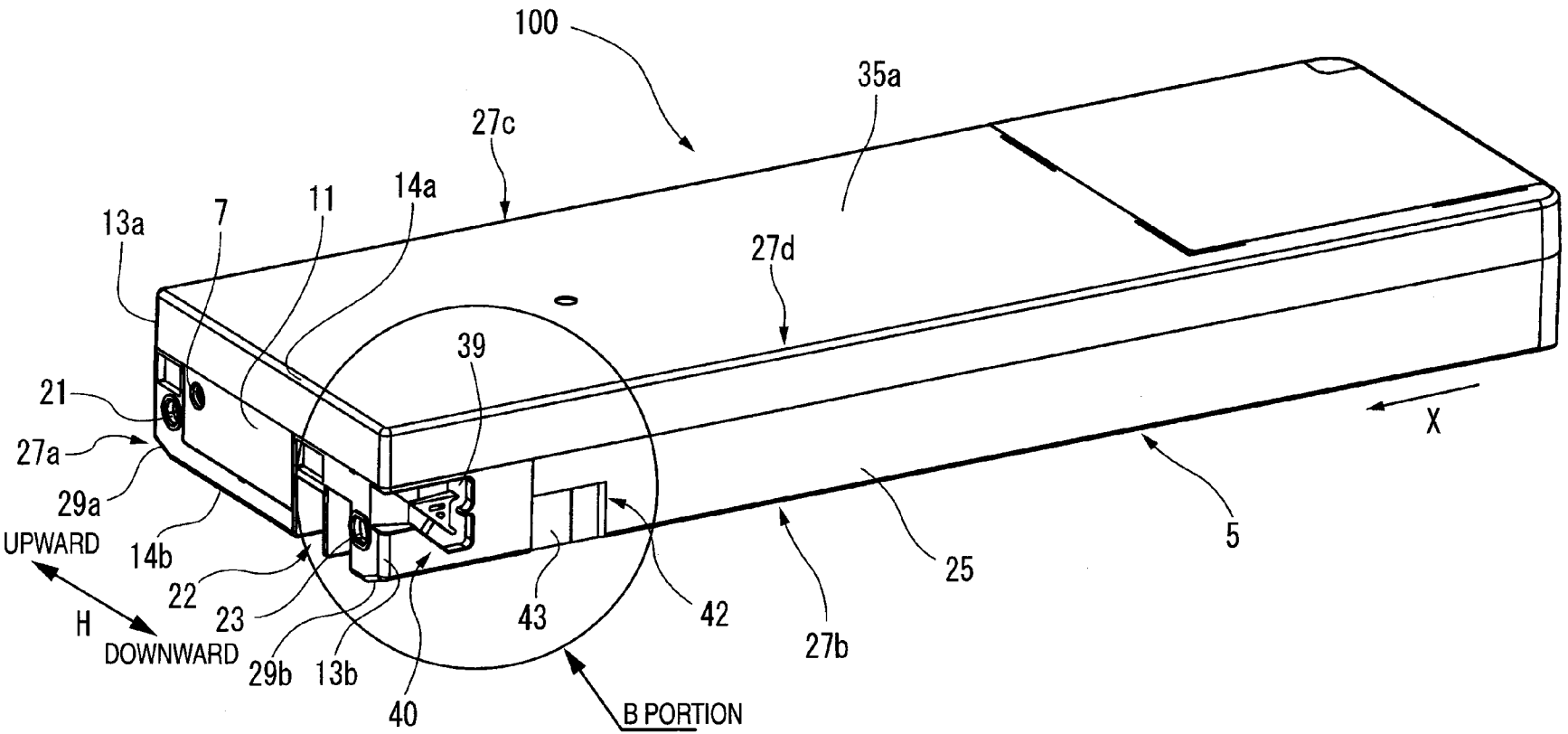
FIG. 12 is a perspective view illustrating the liquid container when viewed from another side surface.

FIG. 9 is a perspective view illustrating the liquid container when viewed from one side. FIG. 10 is an exploded perspective view illustrating the liquid container shown in FIG. 9. FIG. 11 is a diagram illustrating the container holder taken along the line A-A. FIG. 12 is a perspective view illustrating the liquid container when viewed from another side.

The ink cartridge 100 includes a case 5 with a substantially flat rectangular parallelepiped shape as shown in FIG. 9. As shown in FIG. 10, a bag receiving portion 3 is formed in the inside of the case 5. As the liquid container chamber, an ink pack 20 is accommodated in the bag receiving portion 3. In addition, the ink cartridge 100 includes a liquid residual quantity detection unit 30 and an ink supply port 7 (the liquid supply port). The liquid residual quantity detection unit 30 can be attached to or detached from the case 5. The ink supply port 7 is disposed in the liquid residual detection unit 30.

The case 5 is a chassis formed of a resin. The case 5 includes the bag receiving portion 3 with a substantial box shape of which the upper portion is opened and a detection unit receiving portion 4 positioned in the front surface of the bag receiving portion 3. The ink pack 20 and resin spacers 26 are accommodated in the bag receiving portion 3. The ink pack 20 is a flexible bag formed of an aluminum lamination multilayered film in which an aluminum layer is laminated on a resin film layer. The resin spacers 26 are mounted on the inclined portions of the front and rear of the ink pack 20. The liquid residual quantity detection unit 30 is accommodated in the detection unit receiving portion 4.

The opened surface of the bag receiving portion 3 is sealed by a sheet film 24 after receiving the ink pack 20 and the resin spacers 26. The pressurizing chamber is partitioned in the case 5 by the bag receiving portion 3 and the sheet film 24.

When the upper surface of the bag receiving portion 3 is covered with the sheet film 24 and the bag receiving portion 3 is sealed, the spacers 26 prevents the ink pack 20 from being shaken in the sealed case and also fill the empty spaces in the sealed case to improve pressurization efficiency when the bag receiving portion 3 is pressurized by pressurization air.

A resin cover 6 is mounted on the sheet film 24 sealing the opened surface of the bag receiving portion 3 and the detection unit receiving portion 4.

In this embodiment, there is provided five types of the ink cartridges 100. Different five-color ink is stored in the ink packs 20 of the five-type ink cartridges 100. The five-type ink cartridges 100 have the same configuration except for the ink types stored in the ink packs 20 and the detailed shape of the identification portions 22 described above.

As shown in FIGS. 9 and 11, each ink cartridge 100 includes a substantially rectangular front end surface 11 and a rear end surface 12 opposite the front end surface 11. When the ink cartridges 100 are mounted in the cartridge slots 7A to 7E, each front end surface 11 and each rear end surface 12 are a front end and a rear end in the insertion direction, respectively. As shown in FIGS. 7, 8, 9, 11 and 12, each ink cartridge 100 has a first side surface 15 intersecting a first short side 13*a* of the substantially rectangular front end surface 11, a second side surface 25 intersecting a second short side 13*b* of the substantially rectangular front end surface 11, a third side surface 35*a* intersecting a long side 14*a* of the substantially rectangular front end surface 11, and a fourth side surface 35*b* intersecting a second long side 14*b* of the substantially rectangular front end surface 11.

As shown in FIGS. 7, 8, 11, the ink cartridges 100 are lengthwise mounted in the cartridge slots 7A to 7E.

The ink cartridges 100 are mounted in the cartridge slots 7A to 7E so that each first side surface 15 and each second side surface 25 face to the upper side and the down side, respectively. In addition, the plurality of ink cartridges 100 are placed in parallel on the board 241 in lines so that each third side surface 35*a* and each fourth side surface 35*b* are opposed in a direction parallel to the vertical surface. As shown in FIG. 7, one of one pair of support sidewalls 262 of the cartridge holder 200 is opposed to one of the third side surfaces 35*a* of the ink cartridges 100 in both outer ends. In addition, the other of the one pair of support sidewalls 262 thereof is opposed to the other of the fourth side surface 35*b* of the ink cartridges 100 in both outer ends.

Figure 15:
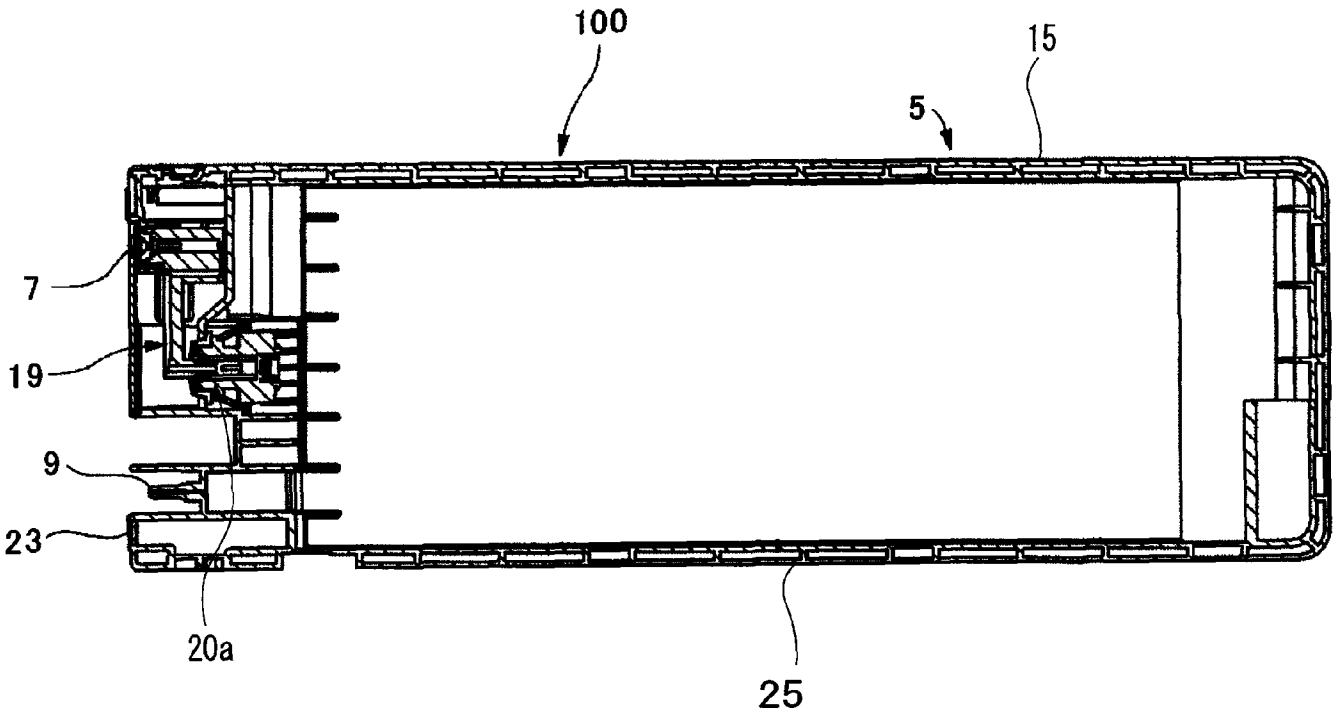
FIG. 15(*a*) is a top view illustrating a front end surface 11 of each ink cartridge 100.
Figure 15:
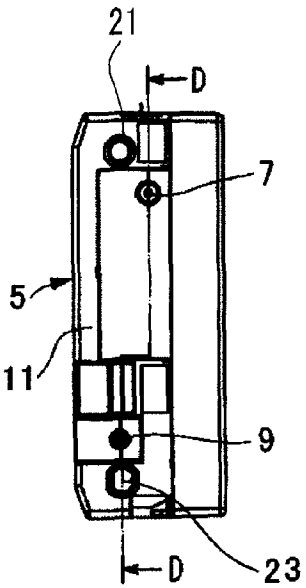

As shown in FIGS. 9 and 15, the ink supply port 7 and an air inflow port 9 are disposed in each front end surface 11. The ink supply port 7 is connected to an ink ejecting port 20*a* of the ink pack 20 (see FIG. 10). The ink ejecting port 20*a* is positioned near the center portion of the front end surface of the ink pack 20. That is, when the ink cartridges 100 are mounted in the cartridge slots 7A to 7E, each of the ink supply ports 7 is disposed on a portion more than the center portion in a height direction (vertical direction) of the ink pack 20. In addition, a flow passage 19 is disposed between the ink supply port 7 and the ink ejecting port 20*a* to communicate therewith.

When the ink cartridges 100 are not mounted in the cartridge slots 7A to 7E, each ink supply port 7 is blocked by a valve or a sealing member. A pressure (static pressure) by which ink contained in the ink pack 20 is flown out from the ink supply port 7 is applied to the ink supply port 7. As an amount of ink contained in the ink pack 20 is larger, the static pressure increases. Accordingly, the static pressure (initial static pressure) is relatively high in a state where the ink is sufficiently filled. In addition, when the ink supply port 7 is opened in a state where the static pressure in the ink pack 20 is relatively high, the ink may flow out from the ink supply port 7.

However, if the ink supply port 7 is configured to be positioned above the center portion in the height direction (vertical direction) of the ink pack 20 according to this embodiment, the static pressure of the ink in the ink pack 20 becomes lower at a position in which the ink supply port 7 is disposed. Moreover, flow resistance caused by the flow passage 19 which connects the ink supply port 7 to the ink ejecting port 20*a* reduces the static pressure applied to the ink supply port 7. That is, according to this embodiment, even when the ink cartridges 100 are mounted in the cartridges slots 7A to 7E and the ink supply pins 249 are inserted into the ink supply ports 7, it is difficult for the ink to leak from the ink supply ports 7.

With reference to FIGS. 1, 4, 5, and 9 to 12, the ink supply from the ink packs 20 to the print head 225 will be described.

When the ink cartridges 100 are mounted in the cartridge slots 7A to 7E, the ink supply pins 249 described above are inserted into the ink supply ports 7. The ink supply pins 249 are connected to the print head 225 through the ink supply passages 223 and the valve units 224.

When the ink cartridges 100 are mounted in the cartridge slots 7A to 7E, the air inflow ports 9 are inserted into the air communicating ports 248 described above. The air communicating ports 248 are connected to the pressurizing pump 226 through the pressurization air supply passage 227. The pressurizing pump 226 can pressurize the ink packs 20 by supplying pressurization air to the bag receiving portions 3 through the pressurization air supply passages 227, the air communicating ports 248, and the air inflow ports 9. By pressurizing each of the ink pack 20 in this way, the ink flowing out from the ink ejecting port 20*a* of each of the ink packs 20 is supplied to the print head 225 of the ink jet printing apparatus 211 through the ink supply port 7.

As shown in FIGS. 9 and 12, one pair of positioning holes 21 and 23 are disposed on the front end surface 11 of each ink cartridge 100 so as to be spaced from each other. With reference to FIGS. 4, 5, 9, 11, the functions of the positioning holes 21 and 23 and the one pair of positioning pins 247 described above will be described.

When the ink cartridges 100 are mounted in the cartridge slots 7A to 7E, the front ends of the positioning pins 247 are fitted to the positioning holes 21 and 23. Afterward, when the ink cartridges 100 are further inward inserted into the cartridge slots 7A to 7E, the ink cartridges 100 are moved on the basis of the positioning pins 247.

When the ink cartridges 100 are mounted in the cartridge slots 7A to 7E, the positioning holes 21 and 23 are fitted to the one pair of positioning pins 247. At this time, since a direction of the front end surface 11 of each ink cartridge 100 is determined, the movement of the ink cartridges 100 in the direction along the front end surface 11 is regulated.

Moreover, as shown in FIG. 11, the one pair of positioning holes 21 and 23, the circuit board 17, and the apparatus fixation structure 40 described above are arranged on the substantial same vertical section taken along the line A-A (see FIG. 8).

According to this embodiment, as shown in FIGS. 9 and 12, the positioning hole 21 is configured to be a hollow hole which is a shape substantially corresponding to the sectional surface perpendicular to the shaft direction of the positioning pin 247. In addition, the positioning hole 23 is configured to be a slim long hole in the height direction (arrow H direction in FIGS. 9 and 12, that is, a vertical direction) of the case 5. In this way, it is possible to maintain location precision and also allow size tolerance or the like by forming the positioning hole 23 with the long hole.

That is, when the ink cartridges 100 are mounted in the cartridge slots 7A to 7E, the location precision of the ink cartridges 100 in the cartridge slots 7A to 7E is maintained by the positioning hole 21 in the upper portion. Relative location deviation of the positioning hole 23 and the positioning pin 247 (see FIG. 4) due to size tolerance or the like is absorbed by the positioning hole 23 in the lower portion. In addition, the ink takeout port 7 is disposed in the vicinity of the positioning hole 21 in the upper portion, which maintains the location precision. Accordingly, the ink takeout port 7 and the ink supply pin 249 (see FIG. 4) are positioned with good precision.

As shown in FIG. 9, the circuit board 17 is disposed on the first side surface 15 of each ink cartridge 100. The circuit board 17 is disposed in a position closer to the front end surface 11 than the rear end surface 12, in particular, almost adjacent to the front end surface 11. A memory element (not shown) for recording information such as an amount of residual ink or cartridge use history is mounted in the circuit board 17.

A residual quantity detecting sensor (sensor using piezoelectric element) (not shown) is mounted in the liquid residual quantity detecting unit 30. The residual quantity detecting sensor is a sensor for detecting an amount of residual ink in each ink cartridge 100. At least one electrode electrically connected to the residual quantity detecting sensor is disposed on the circuit board 17.

As shown in FIG. 11, the apparatus terminal 250 is disposed on the upper portion of each of the circuit boards 17. When the ink cartridges 100 are mounted in the cartridges slots 7A to 7E (see FIGS. 3, 7, and 8), as described above, the contact point 17*a* of the electrode of each of the circuit boards 17 come in contact with a contact point 250*a* of the apparatus terminal 250 (see FIGS. 3, 7, and 8). In this way, the electrode and the apparatus terminal 250 are electrically connected to each other.

Moreover, since each of the circuit board 17 is disposed in the vicinity of the front end surface 11 and the positioning hole 23 in the upper portion for maintaining the location precision is disposed in the vicinity of the first side surface 15, the contact point 17*a* of the circuit board 17 and the contact point 250*a* of the apparatus terminal 250 are located with high precision.

When the ink cartridges 100 are mounted in the cartridge holder 200 of the ink jet printing apparatus 211 (see FIG. 1) and the contact points 17*a* of the circuit boards 17 come in contact with the contact points 250*a* of the apparatus terminal 250 of the container mounting portions 1, the memory elements or the residual quantity detecting sensors are electrically connected to a control circuit of the ink jet printing apparatus (see FIG. 1) through the circuit boards 17. An operation of the memory elements or the residual quantity detecting sensors can be controlled by the ink jet printing apparatus 211 (see FIG. 1).

As shown in FIGS. 7 to 9 and 12, a corner portion 27*a* corresponding to a side in which the first side surface and the fourth side surface 35*b* of each ink cartridge 100 intersect each other and a corner portion 27*b* corresponding to a side in which the second surface 25 and the fourth side surface 35*b* intersect each other are formed in a notched shape in the insertion direction (arrow X direction shown in FIG. 12) of the ink cartridges 100. That is, one pair of chamfered surfaces 29*a* and 29*b* are disposed in the corner portions 27*a* and 27*b*, respectively. As shown in FIGS. 2 to 5, 7, and 8, there is no wall for partitioning boundaries between the ink cartridges 100 in the inside of the cartridge holder 200.

When the substantially flat rectangular parallelepiped ink cartridges 100 are accommodated lengthwise, that is, accommodated in parallel so that the first side surfaces 15 are faced upward and the second side surfaces 25 are faced downward, the ink cartridges 100 are arranged in parallel so that the first side surfaces 35*a* and the fourth side surfaces 35*b* are opposed to each other between the plurality of adjacent ink cartridges 100. In addition, between the adjacent ink cartridges 100, the chamfered surfaces 29*a* and 29*b* of the ink cartridges 100 form sectional triangular spaces 31*a* and 31*b* in a sectional view so as to be extended in the insertion direction of the ink cartridges 100.

As shown in FIGS. 2, 5, 6, and 7, the guide rails 33, which are triangular guide protrusions in a sectional view corresponding to the notched shape (spaces 31*a* 31*b*) of the corner portions 27*a* and 27*b* in which the chamfered surfaces 29*a* and 29*b* are formed, are provided in the insertion direction of the ink cartridges 100.

As shown in FIGS. 3 and 4, the triangular guide protrusions 265 in a sectional view corresponding to the upper spaces 31*a* formed by the upper chamfered surfaces 29*a* are disposed at least in the vicinity of attaching or detachment openings of the cartridge slots 7A to 7E. The guide protrusions 265 are arranged on the top portions so as to be opposed to the guide rails 33 disposed on the support board 241. Accordingly, of the triangular spaces 31*a* and 31*b* in a section view, the lower spaces 31*b* are configured to be the spaces for installing the guide rails 33 and the upper spaces 31*a* are configured to be the spaces for installing the guide protrusions 265.

In the configuration in which the sectional triangular guide rails 33 corresponding to the chamfered surfaces 29*b* are arranged along the insertion direction of the ink cartridges 100, when the plurality of substantially flat rectangular parallelepiped ink cartridges 100 are mounted in the cartridge holder 200 lengthwise in parallel, the substantially same sectional triangular guide rails 33 can be arranged in the sectional triangular spaces 31*b* formed in the lower portions between the adjacent ink cartridges 100 in the insertion direction of the ink cartridges 100.

The ink cartridges 100 are guided in the insertion direction by the guide rails 33 and located in the cartridge holder 200. Accordingly, partition walls for partitioning the cartridge slots 7A to 7E of the cartridge holder 200 between the adjacent ink cartridges 100 are not necessary.

When pressurization air is introduced into the bag receiving portions 3 and the ink packs 20 are pressured from the outside in order to supply the ink to ink jet printing apparatus 211, as shown as an imaginary line in FIG. 8 the one pair of largest surface (the third and fourth side surfaces 35*a* and 35*b*) parallel to each other of the cases 5 of the ink cartridges 100 are expanded and deformed. Degree of the expansion and deformation depends on various conditions such as a material of the cases 5 of the ink cartridges 100 or a pressure of the pressurizing air introduced into the bag receiving portions 3. For example, when the pressure of the pressurizing air is in the range of 12 to 18 kPa, one of the largest surfaces may be expanded and deformed in the range of 5 to 10 mm.

In this embodiment, there is no partition wall in the cartridge holder 200. Accordingly, when the pressurizing air is introduced into the bag receiving portions 3, the largest surfaces 35*a* and 35*b* of the adjacent cases 5 are expanded and deformed. In addition, parts of the largest surfaces 35*a* and 35*b* of the adjacent ink cartridges 100 come in contact with each other in the cartridge slots 7A to 7E with no partition wall. In addition, of the largest surfaces 35*a* and 35*b* of the ink cartridges 100 in both outer ends, as shown in FIG. 7, at least parts of the largest surfaces 35*a* and 35*b* which are not opposed to the largest surfaces 35*a* and 35*b* of the other ink cartridges 100 come in contact with the support sidewalls 262 of a frame body 260 which are opposed to each other.

That is, when the pressurizing fluid is introduced into the ink cartridges 100 mounted in the cartridge slots 7A to 7E, as shown in FIG. 7, the ink cartridges 100 become a locked state between the one pair of support sidewalls 262 by the expansion force. In addition, the plurality of ink cartridges 100 of which the expansion and deformation are regulated are fixed on the cartridge slots 7A to 7E firmly and integrally.

Alternatively, when the pressurization in the pressurizing chamber is released and the expanded ink cartridges 100 return to the original shape, the adjacent ink cartridges 100 do not come in pressing contact with each other any longer and the ink cartridges 100 and the support sidewalls 262 do not come in pressing contact with each other any longer.

Figure 13:
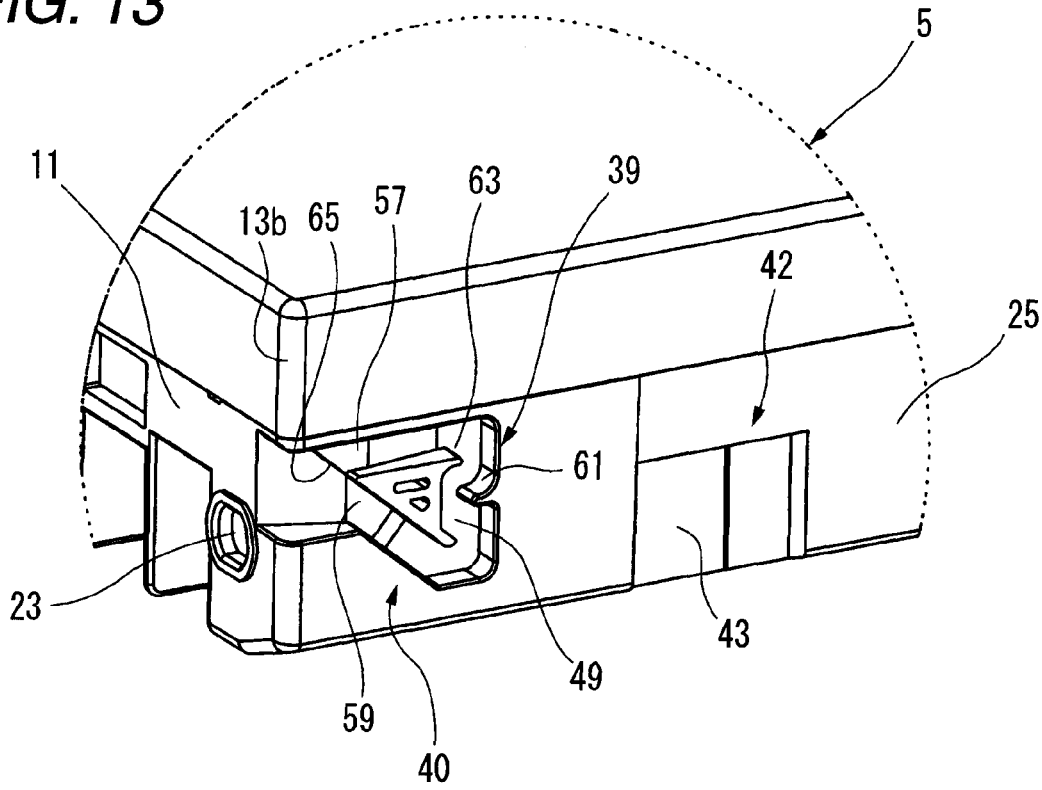
FIG. 13 is an enlarged view illustrating a B portion shown in FIG. 12.
Figure 14:
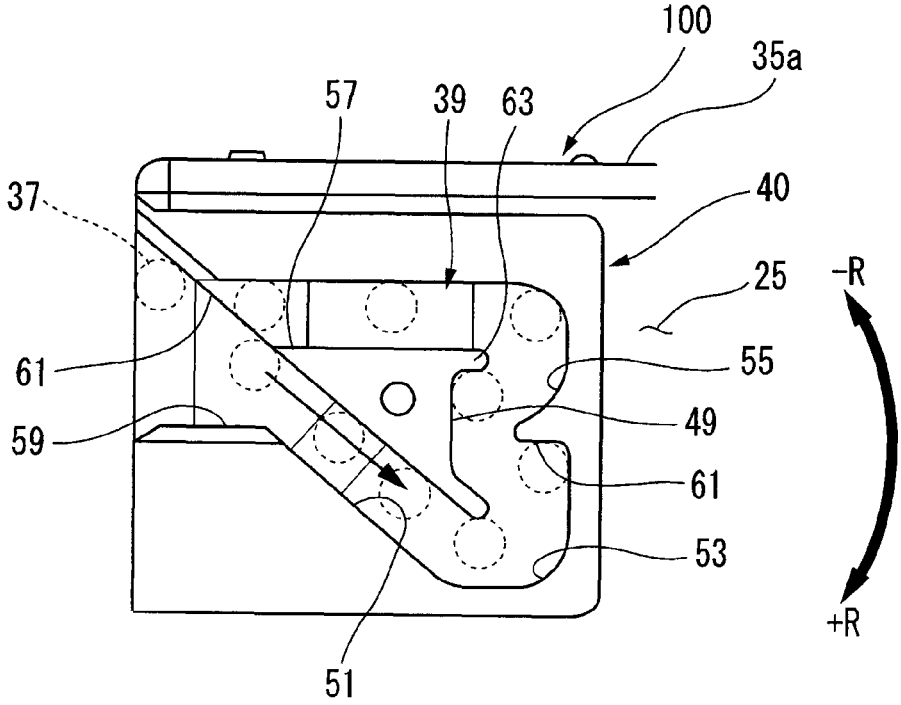
FIG. 14 is an enlarged top view illustrating a guide groove shown in FIG. 13.

FIG. 13 is a partly expanded view illustrating a B portion shown in FIG. 12. FIG. 14 is an expanded top view illustrating the guide groove shown in FIG. 13.

In the second side surface 25, as shown in FIGS. 12 and 13, there is disposed a container fixation structure 40 for releasably regulating the movement of the ink cartridge in the direction opposite the insertion direction of the ink cartridges 100 in cooperation with the apparatus fixation structure 50 disposed in each of the cartridge slots 7A to 7E in the state where each ink cartridge 100 is mounted in each of the cartridge slots 7A to 7E against an urging force in the direction opposite the insertion direction. The apparatus fixation structure 40 is disposed in a position closer to the front end surface 11 than the rear end surface 12, in particular, almost adjacent to the front end surface 11. In addition, on the second side surface 25, a concave portion 43 is disposed in a position more away than the container fixation structure 40 from the front end surface 11. The concave portion 43 is not adjacent to the front end surface 11, but is disposed in a position closer to the front end surface 11 than the rear end surface 12.

As shown in FIG. 13, the container fixation structure 40 includes a guide groove 39 into which the locking pin 37 of the apparatus fixation structure 50 (see FIG. 3) and which guides the locking pin 37, which is a locking member, to a lock position at the time each ink cartridge 100 is attached to or detached from the cartridge slots 7A to 7E. In the state where each ink cartridge 100 is mounted in the cartridge slots 7A to 7E, the container fixation structure 40 includes a locking portion 49 in which the locking pin 37 is engaged and which regulates the movement of the ink cartridge in a pulling direction of each ink cartridge 100.

As shown in FIG. 13, each of the guide grooves 39 includes an entrance guide portion 51 for guiding the locking pin 37 at the time the ink cartridges 100 are inserted into the cartridge slots 7A to 7E, a midway guide portion 53 for guiding the locking pin 37 at the time the ink cartridges 100 inserted into the cartridge slots 7A to 7E return in the pulling direction, and an exit guide portion 55 for guiding the locking pin 37 taken out from the engagement portion 49 by pushing the ink cartridges 100 in the insertion direction at the time the ink cartridges 100 are detached from the cartridge slots 7A to 7E.

Since an exit portion 57 is connected to an entrance portion 59, the guide groove 39 overall has a loop configuration. Since the groove depth of the exit portion 57 is shallower than that of the entrance portion 59 in a connection portion of the entrance portion 59 and the exit portion 57, an uneven portion 65 is formed in the connection portion. Each of the uneven portions 65 prevents the locking pin 37 from entering the exit portion 57 when the ink cartridges 100 are inserted into the cartridge slots 7A to 7E.

The apparatus fixation structure 50 is provided blow the container fixation structure 40. As described above, the apparatus fixation structure 50 includes The lever member 45 and the spring 44 shown in FIG. 6(*b*).

The lever member 45 is urged in a fixed rotation direction by the spring 44. This direction is an arrow −R direction shown in FIG. 6(*b*) and a counterclockwise direction shown in FIG. 13. When the ink cartridges 100 are attached to or detached from the cartridge slots 7A to 7E, each of the locking pins 37 is inserted and guided to the guide groove 39 and the lever member 45 rotates in ±R direction along the shape of the guide groove 39.

As shown in FIG. 11, the locking pin 37 provided in the front end portion of the lever member 45 is disposed in a direction intersecting the second side surface 25 of each ink cartridge 100. When the locking pin 37 is inserted into the guide groove 39, the locking pin 37 upward presses the bottom surface of the guide groove 39 by an elastic force of the lever main body 47 constituting the lever member 45.

Next, an operation of the locking pin 37 in the guide groove 39 at the time the ink cartridges 100 are attached or detached will be described with reference to FIG. 14.

When the ink cartridges 100 are inserted into the cartridge slots 7A to 7E and the ink cartridges 100 are further pushed against the urging force of the slider member 244 (see FIGS. 4 and 5) in the insertion direction, each locking pin 37 is inserted into the entrance portion 59 of the guide groove 39.

The locking pin 37 is urged toward the direction of the bottom surface of the guide groove 39 by elastically deforming the lever main body 47 (see FIG. 6) of the lever member 45 (see FIG. 6). When the locking pin 37 moves beyond the longitudinal end portion of the entrance guide portion 51, the locking pin 37 is moved in the counterclockwise direction in FIG. 14 by the urging force of the spring 44 (see FIG. 6)

In addition, when the locking pin 37 collides with an interim stopping sidewall 61 and stops, the click sounds. The click allows a user to check the ink cartridges 100 are sufficiently inserted.

Next, when the pressing pressure of the user in the insertion direction is released, the ink cartridges 100 moves back a little in the pulling direction due to the urging force of the slider member 246 (see FIGS. 4 and 5). In this way, when the engagement of the locking pin 37 in the interim stop sidewall 61 is released, the locking pin 37 is moved in the counterclockwise direction by the urging force of the spring 44.

In addition, when the locking pin 37 collides with an end stop sidewall 63 formed in the locking portion 49 and stops in the lock position, the clock sounds. The click allows the user to check the ink cartridges 100 are fixed on the cartridge slots 7A to 7E (see FIGS. 2, 4, 5, 7, and 8). Moreover, even when the ink cartridges 100 are mounted in the cartridge slots 7A to 7E, the locking pins 37 press the bottom surface of the guide grooves 39 by the elastic force of the lever main body 47.

When the ink cartridge 100 is attached or detached, the engagement of the locking pin 37 in the end stop sidewall 63 is released by pushing the locked ink cartridge 100 and the locking pin 37 is relatively moved to a non-lock position along the exit guide portion 55 by the urging force of the lever member 45 generated by the spring 44. At this time, the ink cartridge 100 is pushed frontward by the urging force of the slider member 246 (see FIG. 3). The locking pin 37 is directed toward the exit portion 57 in accompaniment of the movement of the ink cartridge 100. Subsequently, by taking out each locking pin 37 from the corresponding exit portion 57, the ink cartridges 100 can be detached from the cartridge slot 7A to 7E.

In addition, as shown in FIGS. 12 and 13, the concave portion 43 is disposed on the second side surface 25 of each ink cartridge 100, but does not have a special function.

Next, a positional relation between the apparatus terminal 250 and the locking pin 37 at the time each ink cartridge 100 is mounted, that is, the locking pin 37 is locked in the locking portion 49 will be described mainly with reference to FIG. 11.

The apparatus terminal 250 includes the contact point 250*a* connected to the contact point 17*a* of the electrode of the circuit board 17 disposed in the first side surface 15 of each ink cartridge 100. The contact point 250*a* is connected to the contact point 17*a* in a position closer to the front end surface 11 of each ink cartridge 100 by a distance S than the position in which the locking pin 37 is locked in the locking portion 49.

In this embodiment, as described above, when the ink cartridges 100 are mounted in the cartridge slots 7A to 7E, as shown in FIG. 7, the spaces 31*b* is formed by the chamfered surfaces 29 between the adjacent ink cartridges 100. In addition, the guide protrusions 33 are formed in the spaces 31*b*.

The ink cartridges 100 are guided in the insertion direction by the guide protrusions 33 and positioned in the cartridge slots 7A to 7E. That is, there is no partition wall for portioning the cartridge slots 7A to 7E between the adjacent ink cartridges 100.

Accordingly, it is not necessary for the plurality of ink cartridges 100 to be spaced by the partition walls or the guide protrusions 33. That is, it is possible to accommodate the plurality of ink cartridges 100 more closely (with high density). Accordingly, it is possible to form the compact cartridge holder of which a total reception size is smaller in a thickness direction of the container holder. Moreover, it is possible to allow the overall ink jet printing apparatus 211 to be compact.

According to this embodiment, as described above, when the ink cartridges 100 are pressurized, the expansion and deformation of the liquid containers are regulated. Accordingly, it is possible to prevent the apparatus terminal 250 and of the contact point 17*a* of the circuit board 17 from being deviated and prevent the electrical connection thereof from deteriorating. In addition, it is possible to reduce load applied to the engagement portion of the apparatus fixation structure 50 and the container fixation structure 40 describe below. In addition, since the plurality of ink cartridges 100 are fixed on the cartridge slots 7A to 7E firmly and integrally by their expansion force, it is not necessary to form the partition walls for partitioning the cartridge slots 7A to 7E in the container holder 200. As a result, it is possible to simplify the container holder 200 and decrease the size thereof.

Since the contact point 17*a* of the electrode of the circuit board 17 and the apparatus fixation structure 40 are disposed on the first side surface 15 and the second side surface 25 of each of the ink cartridge 100, it is not necessary to form the apparatus terminals 250 or the apparatus fixation structures 50 between the firth side surfaces 35*a* and the fourth side surfaces 35*b* of the adjacent cartridges 100. Accordingly, it is possible to accommodate the plurality of ink cartridges 100 with the high density.

That is, according to this embodiment, it is possible to accommodate the plurality of ink cartridges 100 with the high density without deteriorating the electrical connection between the apparatus terminal 250 and the contact point 17*a* of the circuit board 17.

According to this embodiment, as shown in FIGS. 2 and 5, the plurality of guide rails 33 are disposed on the board 241 on which the third side surfaces 35*a* or the fourth side surfaces 35*b* of the plurality of ink cartridges 100 are opposed in the direction parallel to the vertical surface so as to be arranged in parallel.

Accordingly, when the ink cartridges 100 are mounted in the cartridge slots 7A to 7E, the guide protrusions 33 are formed on the lower portions between the adjacent ink cartridges 100.

That is, when the ink cartridges 100 are attached to or detached from the cartridge slots 7A to 7E, the lower portions of the ink cartridges 100 are guided. Accordingly, it is easy to attach or detach the ink cartridges 100. Moreover, the ink cartridges 100 are more reliably positioned in the cartridges slots 7A to 7E.

As shown in FIGS. 3, 4, and 7, according to this embodiment, the guide protrusions 265 are formed so as to be opposed to the guide rails 33. Accordingly, when the ink cartridges 100 are attached or detached, the lower portions of the ink cartridges 100 are guided by the guide rails 33 and the upper portions thereof are also guided by the guide protrusions 265. Accordingly, it is easier to attach or detach the ink cartridges 100.

The shape of the sectional surface of each guide rail 33 or guide protrusion 265 (see FIG. 4) is not limited to the triangular shape as long as each ink cartridge 100 can be guided so as to be inserted, but various shapes of the sectional surface may be adopted. In addition, the shape of the chamfered surface may be appropriately modified in accordance with the shape of the sectional surface of each guide rail 33 and guide protrusion 265.

Each guide protrusion 265 (see FIG. 4) may be omitted. In this case, the chamfered surface 29*a* corresponding to each guide protrusion 265 may be omitted. Moreover, in accordance with shape or position of each guide protrusion 265 (see FIG. 4) or each guide rail 33, the chamfered surface 29*a* or the chamfered surface 29*b* may be formed on the corner portion 27*c* (see FIGS. 9 and 12) corresponding the side intersecting the third side surface 35*a* with the first side surface 25 or on the corner portion 27*d* (see FIGS. 9 and 12) corresponding to the side intersecting the third side surface 35*a* with the second side surface 25. That is, at least one chamfered surface is formed on one of the corner portions 27*a* to 27*d* corresponding to the sides intersecting two of the first to fourth side surfaces 15, 25, 35*a*, and 35*b*.

According to this embodiment, as shown in FIG. 10, the pressurizing chamber of each ink cartridge 100 is partitioned by the box-like bag receiving portion 3 with one open surface and the sheet film 24 for sealing the open surface. Accordingly, since it is easy to form an airtight configuration of the bag receiving portion 3 and the ink pack 20, it is possible to reduce manufacturing cost.

According to this embodiment, as shown in FIGS. 9, 11, and 12, the one pair of positioning holes 21 and 23 are formed in each ink cartridge 100. In addition, as shown in FIGS. 4 and 5, the one pair of positioning pins 247 inserted into the one pair of positioning holes 21 and 23 are formed in the cartridge slots 7A to 7E. Since the ink cartridges 100 can be mounted in the cartridge slots 7A to 7E with an appropriate inclination, it is easy to mount the ink cartridges 100 in to the cartridge slots 7A to 7E. In addition, even when the ink cartridges 100 are mounted with an erroneous inclination, it is possible to prevent the circuit board 17, the apparatus terminal 250, the container fixation structure 40, the apparatus fixation structure 50, or the like from being broken. In addition, when the ink cartridges 100 are mounted in the cartridge slots 7A to 7E, it is possible to maintain good electrical connection between the circuit board 17 and the apparatus terminal 250 and good fixation between the container fixation structure 40 and the apparatus fixation structure 50.

According to this embodiment, as shown in FIG. 11, the one pair of positioning holes 21 and 23, the circuit board 17, and the container fixation structure 40 are disposed substantially on the same vertical section A-A (see FIG. 8). With such a configuration, the ink cartridges 100 are inserted into the cartridge slots 7A to 7E. At this time, when the one pair of positioning pins 247 are pushed into the one pair of positioning holes 21 and 23, each ink cartridge 100 is positioned in the direction (that is, a direction parallel to the vertical section)

along the front end surface 11. Accordingly, the contact point 17*a* of the circuit board 17 and the contact point 250*a* of the apparatus terminal 250 positioned on one side of the vertical section and the container fixation structure 40 and the apparatus fixation structure 50 positioned on the other side of the vertical section are positioned with the high density in an approach direction or an departing direction.

According to this embodiment, as shown in FIG. 7, the substantially flat rectangular parallelepiped ink cartridges 100 are lengthwise arranged in parallel, but the ink cartridges 100 may be overlapped upward and downward. That is, the third side surface 35*a* or the fourth side surface 35*b* of the ink cartridges 100 may be opposed in a direction perpendicular to the vertical surface.

However, the case where the ink cartridges 100 are lengthwise arranged in parallel, in particular, the case where the first side surface 15 on which the circuit board 17 is formed and the apparatus terminal 250 are disposed on the upper side and the second side surface 25 on which the container fixation structure 40 is formed and the apparatus fixation structure 50 are disposed on the lower side is advantageous in that it is possible to prevent the circuit board 17 from electrically deteriorating due to leaked ink.

According to this embodiment, the circuit board 17, the positioning hole 21, and the ink supply port 7 are all integrated on the upper side. As described above, it is possible to improve position precision of the circuit board 17 and the apparatus terminal 250 and position precision of the ink supply port 17 and the ink supply pin 249 by arranging the circuit board 17, the positioning hole 21, and the ink supply port 7 more closely. In addition, since the ink supply port 7 is formed on the upper portion, the ink ejecting port 20*a* of the ink pack 20 can be formed on the lower side than the ink supply port 7. Accordingly, it is possible to reduce the initial static pressure. That is, like the this embodiment, when the first side surface 15 and the second side surface 25 are disposed on the upper portion and the lower portion, respectively, it is possible to improve the position precision of the circuit board 17 and the apparatus terminal 250 and the position precision of the ink supply port 17 and the ink supply pin 249. In addition, it is easy to realize the configuration in which the initial static pressure can be reduced.

According to this embodiment, as shown in FIG. 11, the circuit board 17 and the container fixation structure 40 are disposed in the position closer to the front end surface 11 than the rear end surface 12. In addition, when the ink cartridges 100 are inserted to the cartridge slots 7A to 7E, the urging means of the apparatus fixation structure 50 urges the locking pins 37 so that the locking pins 37 upward press the bottom surfaces of the guide grooves 39 of the container fixation structure 40. That is, the second side surface 25 which is the bottom surface of each ink cartridge 100 is pressed toward the first side surface 15, which is the upper surface, by the locking pin 37. Accordingly, the contact point 17*a* of the circuit board 17 formed on the first surface 15 of each ink cartridge 100 is configured to be firmly pressed (the contact points 17*a* and 25*a* are approached to each other) to the apparatus terminal 250 of the ink jet printing apparatus 211. As a result, the electrode of the circuit board 17 and the apparatus terminal 250 are reliably connected to each other.

In particular, according to this embodiment, as shown in FIG. 11, when each ink cartridge 100 is mounted, that is, the locking pin 37 is locked in the locking portion 49, the contact point 250*a* comes in contact with the contact point 17*a* in the position closer to the front end surface 11 of each ink cartridge 100 by the distance S than the position in which the locking pin 37 is locked in the locking portion 49. In this case, since the locking pin 37 of the apparatus fixation structure 50 upward presses the bottom surface of the guide groove 39 of the container fixation structure 40, the front end surface 11 of each ink cartridge 100 rotates upward on the support portion 70 of the rear end surface 12.

The contact point 17*a* of the electrode of the circuit board 17 disposed on the first side surface 15 is firmly pressed to the apparatus terminal 250. However, since the contact point 17*a* can move more than the bottom surface of the guide groove 39 of the container fixation structure 40 by the locking pin 37, the contact point 17*a* move to the apparatus terminal 250. Accordingly, since the contact point 17*a* is configured to be more firmly pressed to the apparatus terminal 250, the electrode of the circuit board 17 and the apparatus terminal 250 more reliably are connected with each other.

This application claims priority from Japanese Patent Application Nos. 2006-300935 filed on Nov. 6, 2006 and 2007-240195 filed on Sep. 14, 2007, the entire disclosure of which are expressly incorporated by reference herein.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the spirit and scope of the invention.

What is claimed is:

1. A container holder of a liquid consuming apparatus to which substantially rectangular parallelepiped liquid containers can be detachably mounted, the liquid containers each having a front end surface with a substantially rectangular shape including a first short edge, a second short edge, a first long edge, and a second long edge, a rear end surface opposite to the front end surface, a first side surface intersecting the first short edge, a circuit board disposed on the first side surface, an electrode disposed on the circuit board, a second side surface intersecting the second short edge, a container fixation structure disposed on the second side surface, a third side surface intersecting the first long edge, a fourth side surface intersecting the second long edge, the third and the fourth side surfaces being the largest surfaces, a notch formed at the corner intersecting at least two of the first to fourth side surfaces, a liquid containing chamber for containing a liquid, a pressurizing chamber for pressurizing the liquid containing chamber by introducing a pressurization fluid, and a liquid supply port for supplying the liquid to a liquid ejecting head, the container holder comprising:

a support board adapted to support the second side surface of the plurality of the liquid containers;

a plurality of guide rails protruding on the support board along the insertion direction of the liquid container, each guide rail having a shape corresponding to the shape of a notch of a respective liquid container;

a plurality of container mounting portions partitioned by the plurality of guide rails;

an opposite surface, opposite to the support board and adapted to face the first side surface of the plurality of the liquid containers;

a plurality of apparatus terminals disposed on the opposite surface, each of the plurality of apparatus terminals provided on the opposite surface of each of the cartridge slots, and each of the apparatus terminals adapted to come in contact with the electrodes of each of the liquid containers;

a plurality of apparatus fixation structures, each of the plurality of the apparatus fixation structures provided on the lower side of the each of the cartridge slots, and each of the apparatus fixation structure adapted to releasably regulate a movement of the liquid container in a direction opposite to an insertion direction thereof in cooperation with the container fixation structure of each of the liquid containers;

a pair of support sidewalls adapted to face pair of outermost largest surfaces of the plurality of liquid containers mounted on the container mounting portions.

2. The container holder according to claim 1, wherein the guide protrusion is disposed on a support board on which a plurality of the liquid containers can be arranged in parallel in a state where the largest surfaces of the liquid containers are directed in a direction parallel to a vertical surface.

3. The container holder according to claim 2, wherein a second guide protrusion disposed opposite the guide protrusion disposed on the support board protrudes at least in the vicinity of an opening for attachment and detachment of each container mounting portion.

4. A liquid consuming apparatus comprising:

a liquid ejecting head for ejecting a liquid;

a plurality of substantially rectangular parallelepiped shaped liquid containers, each liquid container having a front end surface with a substantially rectangular shape including a first short edge, a second short edge, a first long edge and a second long edge, the containers also including a rear end surface opposite the front end surface, a first side surface intersecting the first short edge, a second side surface intersecting the second short edge, a third side surface intersecting the first long edge a fourth side surface intersecting the second long edge, the third and the fourth side surfaces being the longest surfaces, a notch formed at the corner intersecting at least two of the first to fourth side surfaces, a liquid containing chamber for containing the liquid, a pressurizing chamber for pressurizing the liquid containing chamber by introducing a pressurization fluid, and a liquid supply port for supplying the liquid to the liquid ejecting head;

a pressurization fluid supply mechanism for introducing a pressurization fluid into the liquid containers, a liquid supply mechanism for supplying the liquid from the liquid containers to the liquid ejecting head;

a liquid container holder constructed to detachably mount the plurality of liquid containers, the container holder including a support board adapted to support the second side surface of the plurality of liquid containers;

the support board including a plurality of guide rails protruding therefrom along the insertion direction of the liquid containers;

a plurality of container mounting portions partitioned by the plurality of guide rails;

an opposite surface, opposite the support board and adapted to face the first side surface of the plurality of liquid containers and a plurality of apparatus terminals disposed on the opposite surface;

wherein the plurality of liquid containers each has:

a circuit board with at least one electrode on the first side surface, a contact point of the electrode being electrically connected to an apparatus terminal on the opposite surface;

a container fixation structure adapted to cooperate with an apparatus fixation structure on the container holder releasably regulating a movement of the liquid container in a direction opposite to insertion direction in cooperation with an apparatus fixation structure on the second side surface; and a notch disposed along the insertion direction formed at a corner portion corresponding to the intersection of at least two of the first to fourth side surfaces of each liquid container, the shape of the notch of each liquid container adapted to fit with the shape of a corresponding guide rail.

5. The liquid consuming apparatus according to claim 4, wherein the pressurizing chamber of each liquid container is partitioned by a box-like bag receiving portion with one open surface and a sheet film sealing the open surface of the bag receiving portion, and wherein the liquid containing chamber of each liquid container is formed by a flexible bag having a liquid lead-out portion for leading out the stored liquid to the outside.

6. The liquid consuming apparatus according to claim 4, wherein a pair of positioning holes are disposed on the front end surface of each liquid container, wherein a pair of positioning pins fitted to the pair of positioning holes are disposed in each container mounting portion, and wherein a movement of each liquid container in a direction along the front end surface is regulated by fitting the pair of positioning holes to the pair of positioning pins.

7. The liquid consuming apparatus according to claim 6, wherein the pair of positioning holes of each liquid container, the circuit board, and the container fixation structure are disposed substantially on the same vertical section.

8. A liquid container adapted to be detachably mounted on a container holder having a plurality of container mounting portions partitioned by guide rails of a liquid consuming apparatus, comprising:

a front end surface having a substantially rectangular shape with a first short side, a second short side, a first lone side, a second long side;

a first side surface intersecting the front end surface at the first short side;

a second side surface intersecting the front end surface at the second short side;

a third side surface intersecting the front end surface at the first long side;

a fourth side surface intersecting the front end surface at the second long side, the third side surface and the fourth side surface being largest surfaces;

a rear end surface opposed to the front end surface;

a liquid supply port for supplying the liquid to the liquid consuming apparatus, the liquid supply port formed on the front end surface;

a circuit board with at least one electrode provided on the first side surface;

a container fixation structure for releasably regulating a movement of the liquid container in a direction opposite to an insertion direction in cooperation with an apparatus fixation structure of the liquid consuming apparatus. the container fixation structure provided on the second side surface; and a notch disposed along the insertion direction in a corner portion corresponding to a side in which at least two of the first to fourth side surfaces of the liquid container intersect each other, the notch adapted to fit with a corresponding guide rail in a container holder for holding the liquid container.

9. The liquid container according to claim 8, further comprising:

a liquid containing chamber for containing a liquid; and a pressurizing chamber for pressurizing the liquid containing chamber by introducing a pressurization fluid, wherein the pressurizing chamber of the liquid container is partitioned by a bag receiving portion with one open surface and a sheet film sealing the open surface of the bag receiving portion, and wherein the liquid containing chamber is formed by a flexible bag having a liquid lead-out portion for leading out the stored liquid to the outside.

10. The liquid container according to claim 8, wherein a pair of positioning holes are formed in the front end surface, and wherein a movement in a direction along the front end surface is regulated by fitting the pair of positioning holes to a pair of positioning pins disposed in the liquid consuming apparatus.

11. The liquid container according to claim 10, wherein the pair of positioning holes, the circuit board, and the container fixation structure are disposed substantially on the same vertical section.

* * * * *